US010822211B2

(12) United States Patent
Shan et al.

(10) Patent No.: US 10,822,211 B2
(45) Date of Patent: Nov. 3, 2020

(54) CRANE HYDRAULIC CONTROL SYSTEM AND CRANE

(71) Applicant: XUZHOU Heavy Machinery Co., LTD., Xuzhou (CN)

(72) Inventors: Zenghai Shan, Xuzhou (CN); Quan Dong, Xuzhou (CN); Donghong Liu, Xuzhou (CN); Xiaoqiang Xiang, Xuzhou (CN); Zhengde Zhang, Xuzhou (CN); Yongjian Deng, Xuzhou (CN); Shuai Wang, Xuzhou (CN); Xiaodong Hu, Xuzhou (CN); Xiaojie Du, Xuzhou (CN); Weichao Zhong, Xuzhou (CN); Jianying Han, Xuzhou (CN)

(73) Assignee: XUZHOU Heavy Machinery Co., LTD., Xuzhou (CN)

( * ) Notice: Subject to any disclaimer, the term of this patent is extended or adjusted under 35 U.S.C. 154(b) by 0 days.

(21) Appl. No.: 16/474,341

(22) PCT Filed: Dec. 30, 2016

(86) PCT No.: PCT/CN2016/113339

§ 371 (c)(1),
(2) Date: Jun. 27, 2019

(87) PCT Pub. No.: WO2018/119972

PCT Pub. Date: Jul. 5, 2018

(65) Prior Publication Data

US 2019/0337775 A1 Nov. 7, 2019

(51) Int. Cl.
*B66C 23/00* (2006.01)
*B66C 13/20* (2006.01)
(Continued)

(52) U.S. Cl.
CPC ..... *B66C 23/54* (2013.01); *B66C 13/20* (2013.01); *B66C 23/82* (2013.01); *F15B 11/024* (2013.01);
(Continued)

(58) Field of Classification Search
CPC .. F15B 1/02; F15B 1/024; F15B 1/021; F15B 21/14; F15B 11/024; B66C 23/54; B66C 13/20; B66C 23/82
See application file for complete search history.

(56) References Cited

U.S. PATENT DOCUMENTS 3,971,215 A * 7/1976 Baron ..... E02F 3/30 60/403
4,731,997 A * 3/1988 Hagin ..... B60K 6/12 60/405
(Continued)

FOREIGN PATENT DOCUMENTS

CN 203095422 U 7/2013
CN 103626057 A 3/2014
(Continued)

OTHER PUBLICATIONS

International Search Report and Written Opinion dated Sep. 27, 2017, in the International Application No. PCT/CN2016/113339, 6 pages.
(Continued)

*Primary Examiner* — Abiy Teka
(74) *Attorney, Agent, or Firm* — Wilmer Cutler Pickering Hale and Dorr LLP

(57) ABSTRACT

The present disclosure relates to the technical field of cranes, and in particular to a crane hydraulic control system and a crane. The crane hydraulic control system of the present disclosure includes a prime mover, an execution control mechanism, a hydraulic baking device, a running energy
(Continued)

recycling device and an operation energy recycling device. By means of cooperation among the operation energy recycling device, the energy recovery device and the hydraulic energy conversion device, kinetic energy in a driving braking process of the crane and the potential energy in a load lowering process are respectively converted into hydraulic energy for recovery, storage and reuse, therefore, the present disclosure can achieve the recovery of the superstructure energy and the lower vehicle energy of the crane so as to effectively reduce the energy waste.

20 Claims, 1 Drawing Sheet

(51) Int. Cl.
*B66C 23/82* (2006.01)
*F15B 11/024* (2006.01)
*F15B 21/14* (2006.01)

(52) U.S. Cl.
CPC ..... *F15B 21/14* (2013.01); *F15B 2011/0243* (2013.01); *F15B 2211/20515* (2013.01); *F15B 2211/30505* (2013.01); *F15B 2211/30515* (2013.01)

(56) References Cited

U.S. PATENT DOCUMENTS

| | | | | |
|---|---|---|---|---|
| 5,852,933 | A * | 12/1998 | Schmidt | F15B 3/00 60/413 |
| 6,854,268 | B2 * | 2/2005 | Fales | F15B 1/024 60/414 |
| 7,775,040 | B2 * | 8/2010 | Khalil | F15B 11/024 60/414 |
| 2013/0125540 | A1 | 5/2013 | Vainonen et al. | |

FOREIGN PATENT DOCUMENTS

| | | | |
|---|---|---|---|
| CN | 104105888 | A | 10/2014 |
| CN | 105201937 | A | 12/2015 |
| EP | 2949951 | A1 | 12/2015 |
| WO | WO-2011/133072 | A1 | 10/2011 |
| WO | WO-2016/041230 | | 3/2016 |

OTHER PUBLICATIONS

Extended European Search Report dated Jun. 4, 2020, in the European Application No. 16925872.0. 5 pages.

* cited by examiner

CRANE HYDRAULIC CONTROL SYSTEM AND CRANE

CROSS REFERENCE TO RELATED APPLICATIONS

This application is a national stage application of PCT International Application No. PCT/CN2016/113339, filed Dec. 30, 2016, the contents of which are incorporated herein by reference in their entirety.

FIELD OF THE INVENTION

The present disclosure relates to the technical field of cranes, and in particular to a crane hydraulic control system and a crane.

BACKGROUND OF THE INVENTION

Energy waste exists in cranes during a driving braking process executed by a lower vehicle and a load lowering process executed by a superstructure. The kinetic energy in the braking process and the gravitational potential energy in the load lowering process are generally converted into thermal energy to be lost, which increases the oil consumption and harmful gas emission, and shortens the service live of a braking device, a prime mover and a hydraulic system.

SUMMARY OF THE INVENTION

One technical problem to be solved by the present disclosure is to recycle the kinetic energy in a crane driving braking process and the potential energy in a load lowering process, so as to reduce the energy waste.

In order to solve the above technical problem, the present disclosure provides a crane hydraulic control system, comprising:

a prime mover, for driving a crane to run;

an execution control mechanism, for controlling an actuator of the crane to execute an operation;

a hydraulic energy conversion device, having a state of power connection with the prime mover, and comprising a pump motor switchable between a pump work condition and a motor work condition, the pump motor is provided with a first work port connected with an oil tank in an on-off mode and a second work port connected with the execution control mechanism in an on-off mode;

an operation energy recycling device, comprising a first energy accumulator connected with the first work port in an on-off mode, and cooperating with the hydraulic energy conversion device to convert gravitational potential energy in a load lowering operation process executed by the actuator into hydraulic energy and store the hydraulic energy in the first energy accumulator, so as to achieve an operation energy recovery function, during which the pump motor is in the motor work condition, the first work port is communicated with the first energy accumulator, an oil passage from the first work port to the oil tank is disconnected, and the second work port is communicated with the execution control mechanism and is disconnected from the second energy accumulator; and a running energy recycling device comprising a second energy accumulator connected with the second work port in an on-off mode, and cooperating with the hydraulic energy conversion device to convert mechanical energy in the braking process of the crane into hydraulic energy and store the hydraulic energy in the second energy accumulator, so as to achieve a driving energy recovery function, during which the pump motor is in the pump work condition, the first work port is communicated with the oil tank, and the second work port is communicated with the second energy accumulator and is disconnected from the execution control mechanism.

In some embodiments, the hydraulic energy conversion device is configured to supply oil to the execution control mechanism when the actuator executes the operation, during which the pump motor is in the pump work condition, the first work port is communicated with the oil tank, and the second work port is communicated with the execution control mechanism and is disconnected from the second energy accumulator.

In some embodiments, the running energy recycling device further comprises a first on-off control device for controlling the communication and disconnection between the first work port and the oil tank, and a second on-off control device for controlling the communication and disconnection between the second work port and the execution control mechanism, the operation energy recycling device further comprises a third on-off control device for controlling the communication and disconnection between the first energy accumulator and the first work port, and the running energy recycling device further comprises a fourth on-off control device for controlling the communication and disconnection between the second energy accumulator and the second work port, wherein:

when the operation energy recovery function is implemented, the first on-off control device controls the oil way from the first work port to the oil tank to be disconnected, the second on-off control device controls the second work port to communicate with the execution control mechanism, the third on-off control device controls the first work port to communicate with the first energy accumulator, and the fourth on-off control device controls the second work port to be disconnected from the second energy accumulator; and when the driving energy recovery function is implemented, the first on-off control device controls the first work port to communicate with the oil tank, the second on-off control device controls the second work port to be disconnected from the execution control mechanism, and the fourth on-off control device controls the second work port to communicate with the second energy accumulator.

In some embodiments:

the first on-off control device comprises a hydraulically controlled check valve, and an oil inlet of the hydraulically controlled check valve communicates with the oil tank, and an oil outlet of the hydraulically controlled check valve communicates with the first work port; and/or the second on-off control device comprises a upper and lower vehicle switching valve, wherein the upper and lower vehicle switching valve comprises a first valve port and a second valve port, the first valve port of the upper and lower vehicle switching valve communicates with the second work port, the second valve port of the upper and lower vehicle switching valve communicates with the execution control mechanism, the upper and lower vehicle switching valve has a first working state and a second working state, when the upper and lower vehicle switching valve is in the first working state, the first valve port of the upper and lower vehicle switching valve is disconnected from the second valve port of the upper and lower vehicle switching valve, and when the upper and lower vehicle switching valve is in the second working state, the first valve port of the upper and lower vehicle switching valve communicates with the second valve port of the upper and lower vehicle switching valve; and/or the third on-off control device comprises a first energy storage control valve, and the first energy storage control valve comprises a first valve port and a second valve port, wherein the first valve port of the first energy storage control valve communicates with the first work port, the second valve port of the first energy storage control valve communicates with the first energy accumulator, and the first energy storage control valve has a first working state and a second working state, when the first energy storage control valve is in the first working state, the first valve port of the first energy storage control valve is disconnected from the second valve port, or the first valve port of the first energy storage control valve unidirectionally communicates with the second valve port of the first energy storage control valve along a direction from the first work port to the first energy accumulator, and when the first energy storage control valve is in the second working state, the first valve port of the first energy storage control valve communicates with the second valve port of the first energy storage control valve; and/or the fourth on-off control device comprises a second energy storage control valve, and the second energy storage control valve comprises a first valve port and a second valve port, the first valve port of the second energy storage control valve communicates with the second work port, the second valve port of the second energy storage control valve communicates with the second energy accumulator, and the second energy storage control valve has a first working state and a second working state, when the second energy storage control valve is in the first working state, the first valve port of the second energy storage control valve is disconnected from the second valve port of the second energy storage control valve, and when the second energy storage control valve is in the second working state, the first valve port of the second energy storage control valve communicates with the second valve port of the second energy storage control valve.

In some embodiments:

the execution control mechanism comprises a winch control mechanism for controlling a winch of the actuator to execute winch lifting or winch lowering operations, and the winch control mechanism comprises a winch motor having a lifting port and a lowering port, the second valve port of the upper and lower vehicle switching valve is connected with the lifting port, and when the execution control mechanism controls the winch to execute the winch lowering operation, the second valve port of the upper and lower vehicle switching valve is communicated with the lifting port, so as to implement a winch lowering operation energy recovery function; and/or the execution control mechanism comprises a derricking control mechanism for controlling the actuator to execute derricking lifting or derricking lowering operations, the derricking control mechanism comprises a derricking cylinder, the second valve port of the upper and lower vehicle switching valve is connected with a rodless cavity of the derricking cylinder, and when the derricking control mechanism controls the actuator to execute a derricking lowering operation, the second valve port of the upper and lower vehicle switching valve is communicated with the rodless cavity of the derricking cylinder, so as to implement a derricking lowering operation energy recovery function.

In some embodiments, the execution control mechanism comprises the winch control mechanism and the derricking control mechanism, and the operation energy recycling device further comprises an energy recovery switching device disposed between the second valve port of the upper and lower vehicle switching valve and the execution control mechanism, the energy recovery switching device for controlling the second valve port of the upper and lower vehicle switching valve to switchably communicate with one of the lifting port and the rodless cavity of the derricking cylinder, so as to switchably implement one of the winch lowering operation energy recovery function and the derricking lowering operation energy recovery function.

In some embodiments, the energy recovery switching device comprises an energy recovery switching valve, the energy recovery switching valve comprises a first valve port, a second valve port and a third valve port, the first valve port of the energy recovery switching valve communicates with the second valve port of the upper and lower vehicle switching valve, the second valve port of the energy recovery switching valve communicates with the lifting port, the third valve port of the energy recovery switching valve communicates with the rodless cavity of the derricking cylinder, and the energy recovery switching valve has a first working state and a second working state, when the energy recovery switching valve is in the first working state, the first valve port and the second valve port of the energy recovery switching valve are communicated with each other and the third valve port thereof is cut off, and when the energy recovery switching valve is in the second working state, the first valve port and the third valve port of the energy recovery switching valve are communicated with each other and the second valve port thereof is cut off.

In some embodiments, the energy recovery switching valve further comprises a fourth valve port communicated with the execution control mechanism, when the energy recovery switching valve is in the first working state and when the energy recovery switching valve is in the second working state, the fourth valve port of the energy recovery switching valve is cut off, and the energy recovery switching valve further has a third working state, in which the fourth valve port and the first valve port of the energy recovery switching valve are communicated with each other, and the second valve port and the third valve port of the energy recovery switching valve are both cut off, so that the hydraulic energy conversion device is configured to supply oil to the execution control mechanism when the actuator executes the operation normally.

In some embodiments:

the winch control mechanism further comprises a winch motor control device for controlling one of the lifting port and the lowering port to take oil and the other to discharge oil, and the fourth valve port of the energy recovery switching valve is connected with the winch motor through the winch motor control device; and/or the derricking control mechanism further comprises a derricking cylinder control device for controlling one of a rod cavity and the rodless cavity of the derricking cylinder to take oil and the other to discharge oil, and the fourth valve port of the energy recovery switching valve is connected with the derricking cylinder through the derricking cylinder control device.

In some embodiments:

the winch motor control device comprises a winch up-down control valve, the winch up-down control valve comprises a first valve port, a second valve port, a third valve port and a fourth valve port, the first valve port of the winch up-down control valve communicates with the fourth valve port of the energy recovery switching valve, the second valve port of the winch up-down control valve communicates with the oil tank, the third valve port of the winch up-down control valve is connected with the lifting port in an on-off mode, the fourth valve port of the winch up-down control valve communicates with the lowering port, and the winch up-down control valve has a first working state and a second working state, when the winch up-down control valve is in the first working state, the first valve port communicates with the third valve port of the winch up-down control valve, and the second valve port communicates with the fourth valve port of the winch up-down control valve; and when the winch up-down control valve is in the second working state, the first valve port communicates with the fourth valve port of the winch up-down control valve, and the second valve port communicates with the third valve port of the winch up-down control valve; and/or the derricking cylinder control device comprises a derricking up-down control valve, the derricking up-down control valve comprises a first valve port, a second valve port, a third valve port and a fourth valve port, the first valve port of the derricking up-down control valve communicates with the fourth valve port of the energy recovery switching valve, the second valve port of the derricking up-down control valve communicates with the oil tank, the third valve port of the derricking up-down control valve is connected with the rodless cavity of the derricking cylinder in an on-off mode, the fourth valve port of the derricking up-down control valve communicates with the rod cavity of the derricking cylinder, and the derricking up-down control valve has a first working state and a second working state, when the derricking up-down control valve is in the first working state, the first valve port communicates with the third valve port of the derricking up-down control valve, and the second valve port communicates with the fourth valve port of the derricking up-down control valve; and when the derricking up-down control valve is in the second working state, the first valve port communicates with the fourth valve port of the derricking up-down control valve, and the second valve port communicates with the third valve port of the derricking up-down control valve.

In some embodiments:

the derricking cylinder control device further comprises a derricking balance valve, the derricking balance valve comprises a first valve port and a second valve port, the first valve port of the derricking balance valve communicates with the third valve port of the derricking up-down control valve, the second valve port of the derricking balance valve communicates with the rodless cavity of the derricking cylinder, and the derricking balance valve has a first working state and a second working state, when the derricking balance valve is in the first working state, the first valve port of the derricking balance valve unidirectionally communicates with the second valve port along a direction from the third valve port of the derricking up-down control valve to the rodless cavity of the derricking cylinder, and when the derricking balance valve is in the second working state, the first valve port of the derricking balance valve communicates with the second valve port; and the third valve port of the energy recovery switching valve communicates with the first valve port of the derricking balance valve.

In some embodiments, the first valve port of the winch up-down control valve is also connected with a main superstructure oil supply device of the crane, so that the main superstructure oil supply device is also configured to supply oil to the winch control mechanism; and/or the first valve port of the derricking up-down control valve is also connected with the main superstructure oil supply device, so that the main superstructure oil supply device is also configured to supply oil to the derricking control mechanism.

In some embodiments, wherein the first valve port of the winch up-down control valve unidirectionally communicates with the fourth valve port of the energy recovery switching valve along a direction from the fourth valve port of the energy recovery switching valve to the first valve port of the winch up-down control valve, and the first valve port of the winch up-down control valve unidirectionally communicates with the main superstructure oil supply device along a direction from the main superstructure oil supply device to the first valve port of the winch up-down control valve; and/or the first valve port of the derricking up-down control valve unidirectionally communicates with the fourth valve port of the energy recovery switching valve along a direction from the fourth valve port of the energy recovery switching valve to the first valve port of the derricking up-down control valve, and the first valve port of the derricking up-down control valve unidirectionally communicates with the main superstructure oil supply device along a direction from the main superstructure oil supply device to the first valve port of the derricking up-down control valve.

In some embodiments, the running energy recycling device further comprises a power transmission control device for controlling the prime mover and the hydraulic energy conversion device to switch between a power connection state and a power disconnection state, wherein in the process of implementing the driving energy recovery function and the operation energy recovery function, the power transmission control device controls the hydraulic energy conversion device and the prime mover to be in the power connection state.

In some embodiments, in the process of the actuator executes the operation, the power transmission control device is for controlling the hydraulic energy conversion device and the prime mover to be in the power connection state.

In some embodiments, the hydraulic energy conversion device further comprises an auxiliary pump, the oil inlet of the auxiliary pump communicates with the oil tank, and the oil outlet of the auxiliary pump communicates with the first work port.

In some embodiments, the oil outlet of the auxiliary pump is further connected with the second work port, and when the pump motor is in the motor work condition, the oil outlet of the auxiliary pump is unidirectionally communicated with the second work port along a direction from the oil outlet of the auxiliary pump to the second work port, so that the auxiliary pump is configured to replenish oil for the pump motor when the pump motor is in the motor work condition.

In some embodiments, the hydraulic energy conversion device further comprises a relief valve connecting the oil outlet of the auxiliary pump and the second work port, the oil inlet of the relief valve communicates with the second work port, and the oil outlet of the relief valve communicates with the oil outlet of the auxiliary pump.

In some embodiments, the operation energy recycling device further comprises a first energy storage pressure detection device for detecting the pressure of the first energy accumulator; and/or the running energy recycling device further comprises a second energy storage pressure detection device for detecting the pressure of the second energy accumulator; and/or the operation energy recycling device further comprises a superstructure pressure detection device for detecting the pressure of the execution control mechanism.

Another aspect of the present disclosure further provides a crane, including an actuator and the crane hydraulic control system of the present disclosure.

Under the cooperation of the operation energy recycling device and the running energy recycling device with the hydraulic energy conversion device, the crane hydraulic control system of the present disclosure is capable of recovering the kinetic energy in the braking process and the potential energy in the load lowering process, storing the recovered kinetic energy and potential energy into the first energy accumulator and the second energy accumulator respectively, and reusing the stored energy again. Thus the recovery of the superstructure energy and the lower vehicle energy of the crane is realized, which effectively reduces the energy waste.

Other features and advantages of the present disclosure will become apparent from the detailed description of the exemplary embodiments of the present disclosure with reference to the drawings.

BRIEF DESCRIPTION OF THE DRAWINGS

To illustrate technical solutions in the embodiments of the present disclosure or in the prior art more clearly, a brief introduction on the drawings which are needed in the description of the embodiments or the prior art is given below. Apparently, the drawings in the description below are merely some of the embodiments of the present disclosure, based on which other drawings may be obtained by those of ordinary skill in the art without any creative effort.

REFERENCE SIGNS

Figure 1:
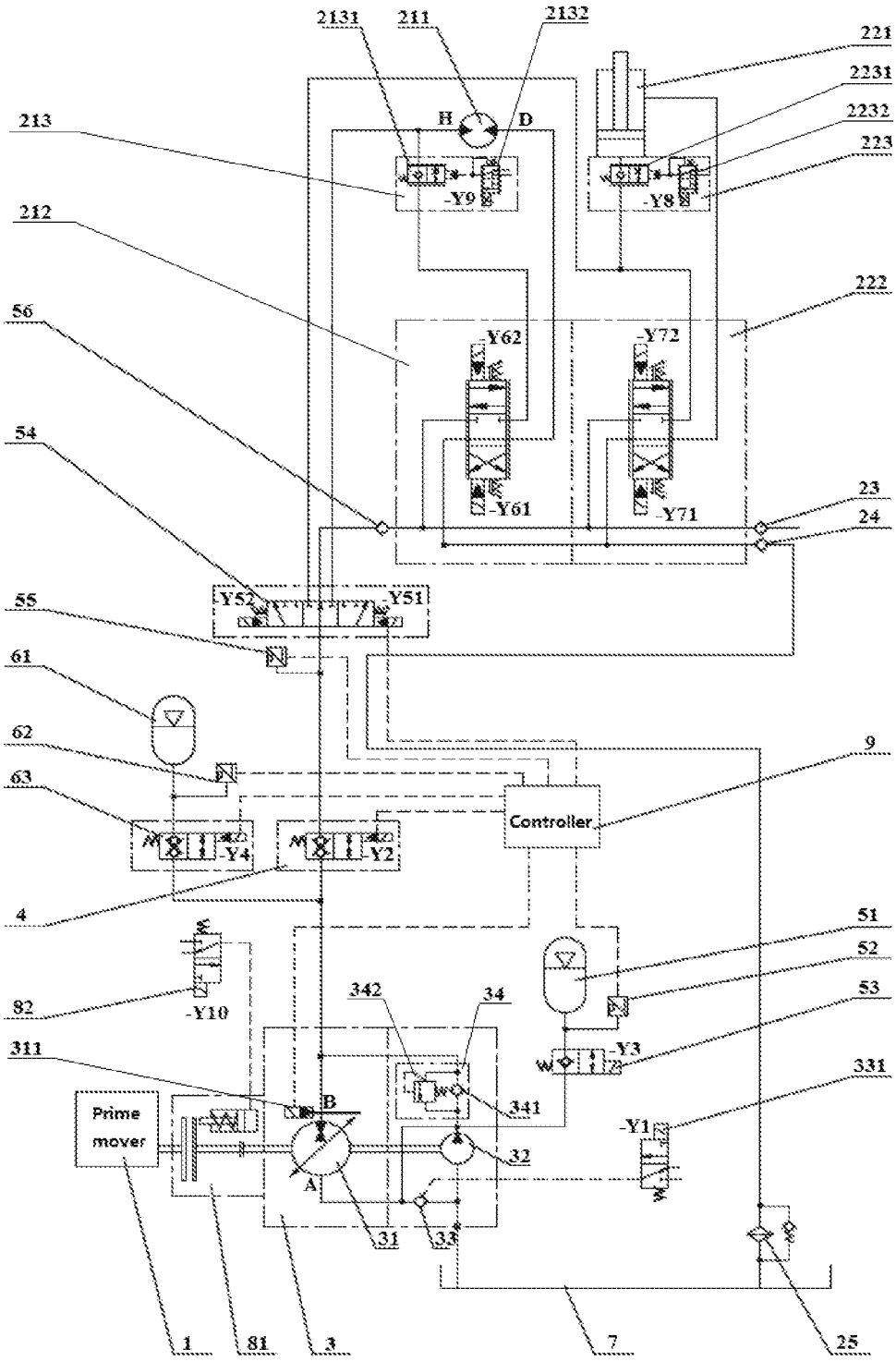
FIG. 1 shows a hydraulic schematic diagram of a crane hydraulic control system of an embodiment of the present disclosure.

1, prime mover;

211, winch motor; 212, winch up-down control valve; 213, winch balance control mechanism; 2131, winch balance valve; 2132, winch balance valve control valve; 221, derricking cylinder; 222, derricking up-down control valve; 223, derricking balance control mechanism; 2231, derricking balance valve; 2232, derricking balance valve control valve; 23, first one-way valve; 24, second one-way valve; 25, oil return filter;

3, hydraulic energy conversion device; 31, pump motor; 311, variable displacement mechanism; 32, auxiliary pump; 33, hydraulically controlled check valve; 331, one-way valve control valve; 34, oil replenishing relief valve; oil replenishing one-way valve; 342, relief valve;

4, upper and lower vehicle switching valve;

51, first energy accumulator; 52, first energy storage pressure detecting device; 53, first energy storage control valve; 54, energy recovery switching valve; 55, superstructure pressure detection device; 56, third one-way valve;

61, second energy accumulator; 62, second energy storage pressure detection device; 63, second energy storage control valve;

7, oil tank;

81, clutch; 82, clutch control device;

9, controller.

DETAILED DESCRIPTION OF THE EMBODIMENTS

A clear and complete description of technical solutions in the embodiments of the present disclosure will be given below, in combination with the drawings in the embodiments of the present disclosure. Apparently, the embodiments described below are merely a part, but not all, of the embodiments of the present disclosure. The following description of at least one exemplary embodiment is actually only illustrative, instead of being any limitation on the present disclosure and application or use thereof. All of other embodiments, obtained by those of ordinary skill in the art based on the embodiments of the present disclosure without any creative effort, fall into the protection scope of the present disclosure.

Techniques, methods and devices known to those of ordinary skill in related art may not be discussed in detail, but where appropriate, the techniques, methods and devices should be regarded as part of the description.

In the description of the present disclosure, it should be understood that orientational or positional relationships indicated by orientational words "front, back, upper, lower, left, right", "transverse, vertical, perpendicular, horizontal" and "top, bottom" and the like are generally orientational or positional relationships as shown in the drawings, and are merely for the convenience of the description of the present disclosure and the simplification of the description, these orientational words do not indicate or imply that the denoted devices or elements must have specific orientations or must be constructed and operated in the specific orientations in the absence of a contrary explanation, and thus cannot be construed as limiting the protection scope of the present disclosure; and the orientational words "inside and outside" refer to the inside and outside of the contours of the components themselves.

In the description of the present disclosure, it should be understood that the use of the terms "first", "second" and the like to define the parts and components is merely for the purpose of facilitating the distinction between the corresponding parts and components, the above words have no specific meaning if not otherwise stated, and thus cannot be construed as limiting the protection scope of the present disclosure.

FIG. 1 shows an embodiment of a crane hydraulic control system of the present disclosure. With reference to FIG. 1, the crane hydraulic control system of the present disclosure includes a prime mover 1 for driving a crane to move, an execution control mechanism for controlling an actuator of the crane to execute an operation, a hydraulic energy conversion device 3 having a power connection state with the prime mover 1, a running energy recycling device and an operation energy recycling device, wherein:

the hydraulic energy conversion device 3 includes a pump motor 31 switchable between a pump work condition and a motor work condition, and the pump motor 31 is provided with a first work port A connected with an oil tank 7 in an on-off mode and a second work port B connected with the execution control mechanism in an on-off mode; the operation energy recycling device includes a first energy accumulator 51 connected with the first work port A in an on-off mode, and the running energy recycling device includes a second energy accumulator 61 connected with the second work port B in an on-off mode;

the operation energy recycling device cooperates with the hydraulic energy conversion device 3 to convert gravitational potential energy in a load lowering operation process executed by the actuator into hydraulic energy and store the hydraulic energy in the first energy accumulator 51, so as to achieve an operation energy recovery function, during which the pump motor 31 is in the motor work condition, the first work port A is communicated with the first energy accumulator 51, an oil passage from the first work port A to the oil tank 7 is disconnected, and the second work port B is communicated with the execution control mechanism and is disconnected from the second energy accumulator 61; and the running energy recycling device cooperates with the hydraulic energy conversion device 3 to convert mechanical energy in the braking process of the crane into hydraulic energy and store the hydraulic energy in the second energy accumulator 61, so as to achieve a driving energy recovery function, during which the pump motor 31 is in the pump work condition, the first work port A is communicated with the oil tank 7, and the second work port B is communicated with the second energy accumulator 61 and is disconnected from the execution control mechanism.

Under the cooperation of the operation energy recycling device and the running energy recycling device with the hydraulic energy conversion device 3, the crane hydraulic control system of the present disclosure is capable of recovering the kinetic energy in the braking process and the potential energy in the load lowering process, storing the recovered kinetic energy and potential energy into the first energy accumulator and the second energy accumulator respectively for reusing. Thus the recovery of the superstructure energy and the lower vehicle energy of the crane is realized, which effectively reduces the energy waste.

In order to implement the above various on-off connections, in the present disclosure, the hydraulic energy conversion device may further include a first on-off control device and a second on-off control device, the operation energy recycling device may further include a third on-off control device, and the running energy recycling device may further include a fourth on-off control device, wherein: the first on-off control device is for controlling the communication and disconnection between the first work port A and the oil tank 7, the second on-off control device is for controlling the communication and disconnection between the second work port B and the execution control mechanism, the third on-off control device is for controlling the communication and disconnection between the first energy accumulator 51 and the first work port A, and the fourth on-off control device is for controlling the communication and disconnection between the second energy accumulator 61 and the second work port B. Furthermore, when the operation energy recovery function is implemented, the first on-off control device controls the oil passage from the first work port A to the oil tank 7 to be disconnected, the second on-off control device controls the second work port B to communicate with the execution control mechanism, the third on-off control device controls the first work port A to communicate with the first energy accumulator 51, and the fourth on-off control device controls the second work port B to be disconnected from the second energy accumulator 61; and when the driving energy recovery function is implemented, the first on-off control device controls the first work port A to communicate with the oil tank 7, the third on-off control device controls the first work port A to be disconnected from the first energy accumulator 51, and the fourth on-off control device controls the second work port B to communicate with the second energy accumulator 61.

As the communication or disconnection between the first work port A and the oil tank 7, the communication or disconnection between the second work port B and the execution control mechanism, the communication or disconnection between the first work port A and the first energy accumulator 51, and the communication or disconnection between the second energy accumulator 61 and the second work port B are configured to be respectively controlled by the first on-off control device, the second on-off control device, the third on-off control device and the fourth on-off control device, the control is more convenient, and the control precision is higher; moreover, with the cooperation of the four on-off control devices, not only the independence and noninterference between the operation energy recovery function and the driving energy recovery function can be ensured to implement a more effective superstructure energy recovery process and a lower vehicle energy recovery process, but also the influence of the operation energy recovery process and the driving energy recovery process on a normal superstructure operation process and a normal lower vehicle running process can be avoided, thereby ensuring that the crane is capable of normally driving or normally operating when no energy recovery is needed. As can be seen, the present disclosure is able to conveniently and effectively ensure the independent and orderly implementation of the normal lower vehicle running process, the normal superstructure operation process, the operation energy recovery process and the driving energy recovery process.

As an embodiment of the second on-off control device of the present disclosure, the second on-off control device may include an upper and lower vehicle switching valve 4, the upper and lower vehicle switching valve 4 includes a first valve port and a second valve port, the first valve port of the upper and lower vehicle switching valve 4 communicates with the second work port B, the second valve port of the upper and lower vehicle switching valve 4 communicates with the execution control mechanism, and the upper and lower vehicle switching valve 4 has a first working state and a second working state, when the upper and lower vehicle switching valve 4 is in the first working state, the first valve port of the upper and lower vehicle switching valve 4 is disconnected from the second valve port, and when the upper and lower vehicle switching valve 4 is in the second working state, the first valve port of the upper and lower vehicle switching valve 4 communicates with the second valve port. In this way, by controlling the upper and lower vehicle switching valve 4 to switch between the first working state and the second working state, the communication and disconnection between the second work port B and the execution control mechanism are controlled conveniently.

The actuator of the crane is usually configured to execute single and multiple operation modes, such as hoisting, derricking and telescoping operations. Accordingly, the execution control mechanism of the crane generally includes a winch control mechanism, an derricking control mechanism, an telescoping control mechanism, and the like, wherein: the winch control mechanism, for controlling a winch of the actuator to execute winch lifting and winch lowering operations, generally includes a winch motor 211 and a winch motor control device, wherein the winch motor 211 is for driving the winch to rotate, the winch motor control device is for controlling the steering of the winch motor 211 by controlling one of a lifting port H and a lowering port D of the winch motor 211 to take oil and the other to discharge oil, so as to control the winch to execute the winch lifting operation or the winch lowering operation, and the winch motor control device generally includes a winch up-down control valve 212 and a winch balance valve 2131; and the derricking control mechanism, for controlling the actuator to execute derricking lifting and derricking lowering operations, generally includes a derricking cylinder 221 and a derricking cylinder control device, the derricking cylinder 221 is for driving a jib to implement derricking, the derricking cylinder control device is for controlling the extension or retraction of the cylinder rod of the derricking cylinder 221 by controlling one of a rod cavity and a rodless cavity of the derricking cylinder 221 to take oil and the other to discharge oil, so as to control the implementation of the derricking lifting operation or the derricking lowering operation, and the derricking cylinder control device generally includes a derricking up-down control valve 222 and a derricking balance valve 2231.

In this case, the crane hydraulic control system of the present disclosure may be configured to only recover the gravitational potential energy in the winch lowering operation process, namely implementing a winch lowering operation energy recovery function, or may be configured to only recover the gravitational potential energy in the derricking lowering operation process, namely implementing a derricking lowering operation energy recovery function.

On the basis of foregoing upper and lower vehicle switching valve 4, to implement the winch lowering operation energy recovery function, the second valve port of the upper and lower vehicle switching valve 4 may be configured to be connected with the lifting port H of the winch motor 211 of the winch control mechanism, in which the second valve port of the upper and lower vehicle switching valve 4 is capable of communicating with the lifting port H when the winch lowering operation energy recovery function needs to be implemented. Based on this, when the winch control mechanism controls the winch to execute the winch lowering operation and when the winch lowering operation energy recovery function needs to be implemented, the oil flowing out from the lifting port H of the winch motor 211 is able to flow to, through the upper and lower vehicle switching valve 4 that is in the second working state, the pump motor 31 working in the motor work condition, and then flow into, through the pump motor 31, the first energy accumulator 51 that is communicated with the first work port A of the pump motor 31, so that the gravitational potential energy lost in the winch lowering operation process is converted into hydraulic energy stored in the first energy accumulator 51, thus realizing the winch lowering operation energy recovery function.

In order to implement the derricking lowering operation energy recovery function, the second valve port of the upper and lower vehicle switching valve 4 may be configured to be connected with the rodless cavity of the derricking cylinder 221, in which the second valve port of the upper and lower vehicle switching valve 4 is capable of communicating with the rodless cavity of the derricking cylinder 221 when the derricking lowering operation energy recovery function needs to be implemented. In this case, when the derricking control mechanism controls the actuator to execute the derricking lowering operation and when the derricking lowering operation energy recovery function needs to be implemented, the oil flowing out from the rodless cavity of the derricking cylinder 221 can flow to, through the upper and lower vehicle switching valve 4 that is in the second working state, the pump motor 31 working in the motor work condition, and flow into, through the pump motor 31, the first energy accumulator 51 that is communicated with the first work port A of the pump motor 31, so that the gravitational potential energy lost in the derricking lowering operation process is converted into hydraulic energy stored in the first energy accumulator 51, thus realizing the derricking lowering operation energy recovery function.

More preferably, the crane hydraulic control system of the present disclosure is configured to not only implement the winch lowering operation energy recovery function, but also to implement the derricking lowering operation energy recovery function. In this case, the running energy recycling device of the present disclosure may further include an energy recovery switching device disposed between the second valve port of the upper and lower vehicle switching valve 4 and the execution control mechanism, and the energy recovery switching device is configured to control the second valve port of the upper and lower vehicle switching valve 4 to switchably communicate with one of the lifting port H of the winch motor 211 and the rodless cavity of the derricking cylinder 221. In this way, when the winch lowering operation energy recovery function needs to be implemented, the energy recovery switching device controls the second valve port of the upper and lower vehicle switching valve 4 to communicate with the lifting port H, so that the hydraulic oil flowing out from the lifting port H conveniently flows into the first energy accumulator 51 for recovery and storage, and when the derricking lowering operation energy recovery function needs to be implemented, the energy recovery switching device conversely controls the second valve port of the upper and lower vehicle switching valve 4 to communicate with the rodless cavity of the derricking cylinder 211, enabling the hydraulic oil flowing out from the rodless cavity of the derricking cylinder 221 to conveniently flow into the first energy accumulator 51 for recovery and storage. Therefore, based on the energy recovery switching device, the winch lowering operation energy recovery function and the derricking lowering operation energy recovery function are switchably implemented in a convenient way, and energy savings and emissions reduction are more effectively achieved.

The energy recovery switching device of the present disclosure may include an energy recovery switching valve 54 including a first valve port, a second valve port and a third valve port, wherein: the first valve port of the energy recovery switching valve 54 is communicated with the second valve port of the upper and lower vehicle switching valve 4, the second valve port of the energy recovery switching valve 54 is communicated with the lifting port H, and the third valve port of the energy recovery switching valve 54 is communicated with the rodless cavity of the derricking cylinder 221; moreover, the energy recovery switching valve 54 has a first working state and a second working state, wherein: when the energy recovery switching valve 54 is in the first working state, the first valve port and the second valve port of the energy recovery switching valve 54 are communicated with each other and the third valve port thereof is cut off, and when the energy recovery switching valve 54 is in the second working state, the first valve port and the third valve port of the energy recovery switching valve 54 are communicated with each other and the second valve port thereof is cut off.

Based on the above energy recovery switching valve 54, when the energy recovery switching valve 54 is in the first working state and the upper and lower vehicle switching valve 4 is in the second working state, the second work port B is capable of communicating with the lifting port H, so that the pump motor 31 can conveniently drive the hydraulic oil from the lifting port H during the winch lowering operation process to flow into the first energy accumulator 51 for storage, thus realizing the winch lowering operation energy recovery function; and when the energy recovery switching valve 54 is in the second working state and the upper and lower vehicle switching valve 4 is in the second working state, the second work port B is capable of communicating with the rodless cavity of the derricking cylinder 221, so that the pump motor 31 is capable of conveniently driving the hydraulic oil from rodless cavity of the derricking cylinder 221 in the derricking lowering operation process to enter the first energy accumulator 51 for storage, thus realizing the derricking lowering operation energy recovery function.

In addition, for more fully utilization of the hydraulic energy conversion device 3, in the present disclosure, the hydraulic energy conversion device 3 is further configured to supply oil for the execution control mechanism when the actuator normally executes the operation (this may be referred to as a superstructure oil supply function of the hydraulic energy conversion device 3 for the convenience of description), at this time, the pump motor 31 is in the pump work condition, the first work port A is communicated with the oil tank 7, and the second work port B is communicated with the execution control mechanism and is disconnected from the second energy accumulator 61. On this basis, the hydraulic energy conversion device 3 of the present disclosure not only can work in the case that energy recovery is needed, but also can work as an oil source of the superstructure when the superstructure works normally, supplying oil to the normal operation process (for example, hoisting, variable amplitude and extension and retraction) of the superstructure, which on one hand improves the utilization rate of the hydraulic energy conversion device 3 and enriches the functions of the hydraulic energy conversion device 3 in the crane hydraulic control system, and on the other hand, makes the hydraulic energy conversion device 3 not only can supply oil to the superstructure operation together with the original oil source of the crane, effectively improving the operation efficiency of the crane and reducing the requirements for the original oil source equipment, but also can singly provide oil for the superstructure without the original oil source, thereby the original oil source can be omitted, which simplifies the overall structure of the crane and reduces the cost.

In order to simplify the structure of the crane hydraulic control system and facilitate the switch control, the superstructure oil supply function of the hydraulic energy conversion device may also be realized based on the aforementioned energy recovery switching valve 54. In order to realize the superstructure oil supply function of the hydraulic energy conversion device 3, the energy recovery switching valve 54 may further include a fourth valve port, the fourth valve port of the energy recovery switching valve 54 communicates with the execution control mechanism, and is cut off in both the first working state and the second working state of the energy recovery switching valve 54, besides the energy recovery switching valve 54 further has a third working state, in which the fourth valve port is communicated with the first valve port of the energy recovery switching valve 54, and the second valve port and the third valve port of the energy recovery switching valve 54 are both cut off. In this way, the energy recovery switching valve 54 still can switchably implement the winch lowering operation energy recovery function and the derricking lowering operation energy recovery function, moreover the communication between the second work port B of the hydraulic energy conversion device 3 and the execution control mechanism can be controlled by making the energy recovery switching valve 54 in the third working state, which facilitates the hydraulic energy conversion device 3 in the pump work condition to supply oil to the execution control mechanism when the actuator normally executes the operation, so as to implement the superstructure oil supply function of the hydraulic energy conversion device 3.

The communication between the fourth valve port of the energy recovery switching valve 54 and the execution control mechanism may be implemented by the communication between the fourth valve port of the energy recovery switching valve 54 and the winch motor control device, for example, the fourth valve port of the energy recovery switching valve 54 may be configured to communicate with the winch up-down control valve 212, in this case, the fourth valve port of the energy recovery switching valve 54 is connected with the winch motor 211 through the winch motor control device, so that the pump motor 31 can supply oil to the winch motor 211 through the winch motor control device; or, The communication between the fourth valve port of the energy recovery switching valve 54 and the execution control mechanism may be implemented may be implemented by the communication between the fourth valve port of the energy recovery switching valve 54 and the derricking cylinder control device instead, for example, the fourth valve port of the energy recovery switching valve 54 may be configured to communicate with the derricking up-down control valve 222, in this case, the fourth valve port of the energy recovery switching valve 54 is connected with the derricking cylinder 221 through the derricking cylinder control device, so that the pump motor 31 can supply oil to the derricking cylinder 221 through the derricking cylinder control device. More preferably, the fourth valve port of the energy recovery switching valve 54 may be configured to communicate with both of the winch motor control device and the derricking cylinder control device, so that the hydraulic energy conversion device 3 is capable of supplying oil to both of the winch work condition and the variable amplitude work condition. Of course, the fourth valve port of the energy recovery switching valve 54 may also be configured to communicate with a telescopic cylinder control device at the same time, so that the hydraulic energy conversion device 3 is capable of supplying oil to a telescoping work condition, the principle of which is similar to that of the derricking work condition, and thus is not described in detail herein.

The present disclosure is further described below in conjunction with the embodiment as shown in FIG. 1. The crane hydraulic control system of the embodiment not only can meet the normal work requirements of on the superstructure and the lower vehicle, but also can implement the energy recovery function, and the energy recovery function includes both of the driving energy recovery function and the operation energy recovery function, moreover, the operation energy recovery function includes both of the winch lowering operation energy recovery function and the derricking lowering operation energy recovery function.

As shown in FIG. 1, in the present embodiment, the crane hydraulic control system includes a prime mover 1, an execution control mechanism, a hydraulic energy conversion device 3, a hydraulically controlled check valve 33 serving as the first on-off control device, an upper and lower vehicle switching valve 4 serving as the second on-off control device, an operation energy recycling device, a running energy recycling device, a power transmission control device and a controller 9.

The prime mover 1 is used as a power source of the crane hydraulic control system, and may be, for example, an engine. The prime mover 1 of the present embodiment is configured to not only provide power for a normal driving process of the crane, but also provide power for the energy recovery process and the normal superstructure operation process of the crane, which is mainly realized by driving the hydraulic energy conversion device 3, and this will be explained in more detail below.

The hydraulic energy conversion device 3 is for realizing the conversion of the hydraulic energy and the mechanical energy. In the present embodiment, the hydraulic energy conversion device 3 is capable of realizing three functions, specifically, the hydraulic energy conversion device 3 not only can implement the operation energy recovery function by cooperating with the operation energy recycling device, but also can implement the driving energy recovery function by cooperating with the running energy recycling device, as well as serve as the superstructure oil source which supplies oil in the normal superstructure operation process. This multi-purpose setting mode of the hydraulic energy conversion device 3 effectively simplifies the structure and control process of the crane hydraulic control system.

It can be seen from FIG. 1 that, the hydraulic energy conversion device 3 in the present embodiment is connected with the prime mover 1 via the power transmission control device, and the hydraulic energy conversion device in the present embodiment includes a pump motor 31 and an auxiliary pump 32.

The pump motor 31 is a hydraulic component capable of mutually converting the hydraulic energy and the mechanical energy (also referred to as a secondary component), and can switch between the pump work condition and the motor work condition, wherein: in the pump work condition, the pump motor 31 is capable of converting the mechanical energy into the hydraulic energy, during which the hydraulic oil flows from the first work port A to the second work port B of the pump motor 31; and in the motor work condition, the pump motor 31 is capable of converting the hydraulic energy into the mechanical energy, during which the hydraulic oil flows from the second work port B to the first work port A of the pump motor 31. No matter in the pump work condition or the motor work condition, the rotation direction of the pump motor 31 in the present embodiment doesn't change, and the difference lies in that the quadrant in which a swing angle of a swash plate thereof is located, that is, the work condition of the pump motor 31 in the present embodiment is switched by controlling the swing angle of the swash plate of the pump motor 31 to change in different quadrants.

As can be seen from FIG. 1, in the present embodiment, the pump motor 31 is connected with the prime mover 1 via the power transmission control device, and under the control of the power transmission control device, the pump motor 31 and the prime mover 1 have a power connection state and a power disconnection state, wherein in the power connection state, the prime mover 1 is capable of transmitting power to the pump motor 31, so that the pump motor 31 can rotate along a certain direction under the driving of the prime mover 1; and in the power disconnection state, the prime mover 1 cannot transmit power to the pump motor 31. Furthermore, as shown in FIG. 1, the pump motor 31 in the present embodiment comprises a variable displacement mechanism 311 for adjusting the swing angle of the swash plate, and the variable displacement mechanism 311 is electrically connected with the controller 9, so that the controller 9 is capable of controlling the variable displacement mechanism 311 to change the position of the swing angle of the swash plate of the motor 31, realizing the control of the work condition switching and the displacement of the pump motor 31. As can be seen, the pump motor 31 in the present embodiment switches the pump work condition and the motor work condition by electronically control the variable displacement, accordingly, the structure is simple, and the control is convenient.

The first work port A of the pump motor 31 serves as an oil suction port when the pump motor 31 is in the pump work condition, and serves as an oil pressing port when the pump motor 31 is in the motor work condition. In the present embodiment, the first work port A of the pump motor 31 is connected with the oil tank 7 in an on-off mode through the hydraulically controlled check valve 33 which is for controlling the connection and disconnected between the first work port A and the oil tank 7.

Specifically, as shown in FIG. 1, an oil inlet of the hydraulically controlled check valve 33 communicates with the oil tank 7, and an oil outlet of the hydraulically controlled check valve 33 communicates with the first work port A. Based on this, when no pressure oil is supplied to a hydraulic control end of the hydraulically controlled check valve 33, the hydraulically controlled check valve 33, working just like an ordinary check valve, controls the hydraulic oil to flow only along a direction from the oil tank 7 to the first work port A, but not along the opposite direction, that is, a locking function of the motor work condition is achieved, therefore, when the superstructure energy needs to be recovered, the hydraulic oil output from the pump motor 31 can be conveniently controlled to flow into the first energy accumulator 51 of the operation energy recycling device for storage, but not flow back into the oil tank 7; and when the pressure oil is supplied to the hydraulic control end of the hydraulically controlled check valve 33, the hydraulically controlled check valve 33 is opened bidirectionally, at this time, the direction of the hydraulic oil flowing through the hydraulically controlled check valve 33 is determined by the fact that which one of the oil inlet and the oil outlet has a greater pressure, if the pressure at the first work port A is greater than the pressure of the oil tank 7, the hydraulic oil flows from the first work port A to the oil tank 7 through the hydraulically controlled check valve 33, in this case, the oil of the first work port A can be conveniently controlled to directly flow back into the oil tank without back pressure when unloading is required or the recovered braking energy needs to be reused.

More specifically, it can be seen from FIG. 1 that, the hydraulic control end of the hydraulically controlled check valve 33 is connected with a one-way valve control valve 331, the one-way valve control valve 331 is for controlling whether the pressure oil is supplied to the hydraulic control end of the hydraulically controlled check valve 33, so as to control the communication and disconnection between the first work port A and the oil tank 7. Of course, the one-way valve control valve 331 is not limited to a two-position three-way solenoid valve structure with a control end Y1 as shown in FIG. 1, in fact, as long as being able to control the pressure oil to pass by the hydraulic control end of the hydraulically controlled check valve 33 or not, all variations shall fall within the protection scope of the present disclosure.

The second work port B of the pump motor 31 is used as the oil pressing port when the pump motor 31 is in the pump work condition, and serves as the oil suction port when the pump motor 31 is in the motor work condition. In the present embodiment, the second work port B of the pump motor 31 is connected with the execution control mechanism in an on-off mode through the upper and lower vehicle switching valve 4, and the upper and lower vehicle switching valve 4 controls the communication and disconnection between the second work port B and the execution control mechanism.

Specifically, as shown in FIG. 1, the upper and lower vehicle switching valve 4 in the present embodiment adopts a single valve structure (a two-position two-way valve), and includes a first valve port and a second valve port, wherein: the first valve port of the upper and lower vehicle switching valve 4 communicates with the second work port B, and the second valve port of the upper and lower vehicle switching valve 4 communicates with the execution control mechanism. Moreover, the upper and lower vehicle switching valve 4 has a first valve position (a left position in FIG. 1) and a second valve position (a right position in FIG. 1), wherein: when the upper and lower vehicle switching valve 4 is at the first valve position, the upper and lower vehicle switching valve 4 works in the first working state, and the first valve port o is disconnected from the second valve port of the upper and lower vehicle switching valve 4, so that the oil way between the second work port B and the execution control mechanism is cut off; and when the upper and lower vehicle switching valve 4 is at the second valve position, the upper and lower vehicle switching valve 4 works in the second working state, and the first valve port communicates with the second valve port of the upper and lower vehicle switching valve 4, so that the oil way between the second work port B and the execution control mechanism is communicated. In this way, by controlling the upper and lower vehicle switching valve 4 to switch between the first valve position and the second valve position, the communication and disconnection between the second work port B and the execution control mechanism can be conveniently controlled, thereby being convenient to control the switch between on the superstructure and lower vehicle and the switch between the driving energy recovery function and the operation energy recovery function.

More specifically, it can be seen from FIG. 1 that, the upper and lower vehicle switching valve 4 in the present disclosure is provided with two reverse one-way valves between the first valve port and the second valve port at the first valve position to disconnect the first valve port from the second valve port at the first valve position. However, those skilled in the art should understand that the disconnection between the first valve port and the second valve port at the first valve position may also be implemented in other manners, such as directly blocking the first valve port and the second valve port; in addition, a control end Y2 of the upper and lower vehicle switching valve 4 as shown in FIG. 1 is electrically connected with the controller 9, and the controller 9 controls the upper and lower vehicle switching valve 4 to switch between the first valve position and the second valve position, but in fact, the upper and lower vehicle switching valve 4 may also switch between the first valve position and the second valve position in other manners, such as hydraulic control, etc.

The auxiliary pump 32 is for converting the mechanical energy into the hydraulic energy, and, for example, may be a centrifugal pump. In the present embodiment, the auxiliary pump 32 also has the power connection state with the prime mover 1, and in order to make the structure of the hydraulic energy conversion device 3 be simpler and more compact and to facilitate the synchronization control of the auxiliary pump 32 and the pump motor 31, the auxiliary pump 32 in the present embodiment is coaxially connected with the pump motor 31, and the auxiliary pump 32 is mainly used for assisting the pressurization to improve the work performance of the hydraulic energy conversion device 3.

As shown in FIG. 1, the oil inlet port of the auxiliary pump 32 in the present embodiment is communicated with the oil tank 7, and the oil outlet port of which is communicated with the first work port A. Based on this, when the auxiliary pump 32 works, the oil pumped from the oil tank 7 can flow to the first work port A of the pump motor 31, which effectively prevents the pump motor 31 in the pump work condition from generating a negative pressure at the first work port A, thereby being not only able to reduce the risk of cavitation erosion generated by the pump motor 31, which is conducive to prolonging the service life of the pump motor 31 and reducing the noise in a working process of the pump motor 31, but also being conducive to enabling the pump motor 31 to have a higher working rotation speed at the maximum pump discharge and improving the work performance of the hydraulic energy conversion device 3.

Moreover, in the present embodiment, the oil outlet of the auxiliary pump 32 is also connected with the second work port B, and when the pump motor 31 is in the motor work condition, the oil outlet of the auxiliary pump 32 is capable of unidirectionally communicating with the second work port B along a direction from the oil outlet of the auxiliary pump 32 to the second work port B. Thus, when the pump motor 31 works in the motor work condition, since the pressure of the second work port B of the pump motor 31 is less than the pressure of the first work port A, the hydraulic oil pumped by the auxiliary pump 32 from the oil tank 7 does not flow to the first work port A along the oil passage between the oil outlet of the auxiliary pump 32 and the first work port A anymore, but directly flows to the second work port B, so that the auxiliary pump 32 is capable of replenishing oil for the pump motor 31 in the motor work condition, thereby effectively preventing an air suction phenomenon of the pump motor 31 in the motor work condition, which facilitates to further extend the service life of the pump motor 31 and further improve the work performance of the pump motor 31. In particular, in the present embodiment, the pump motor 31 in the motor work condition can be used in a re-release and utilization process of the driving brake energy recovered by the running energy recycling device, therefore, the auxiliary pump 32 replenishing oil for the pump motor 31 can also make the re-release and utilization process of the driving brake energy more stable and efficient, which will be further explained below in combination with the work process of the crane hydraulic control system. Furthermore, since the oil outlet of the auxiliary oil pump 32 unidirectionally communicates with the second work port B, the hydraulic oil pumped by the auxiliary pump 32 can still flow to the first work port A when the pump motor 31 works in the pump work condition, so as to replenish oil for the first work port A.

Specifically, in order to achieve the unidirectional communication between the oil outlet of the auxiliary pump 32 and the second work port B along the direction from the oil outlet of the auxiliary pump 32 to the second work port B, as shown in FIG. 1, the hydraulic energy conversion device 3 in the present embodiment further includes an oil replenishing one-way valve 341, whose oil inlet communicates with the oil outlet of the auxiliary pump 32, and oil outlet communicates with the second work port B. Based on this, when the pump motor 31 works in the motor work condition, and the difference between a high pressure at the oil outlet of the auxiliary pump 32 and a low pressure at the second work port B can open the oil replenishing one-way valve 341, the oil outlet of the auxiliary pump 32 is controlled to unidirectionally communicate with the second work port B along the direction from the oil outlet of the auxiliary pump 32 to the second work port B, so that the auxiliary pump 32 is capable of pumping oil to the second work port B, thereby achieving the oil replenishing function; and since the oil replenishing one-way valve 341 is reversely cut off, when the pump motor 31 works in the pump work condition or when the pressure difference between the oil outlet of the auxiliary pump 32 and the second work port B of the pump motor 31 working in the motor work condition is insufficient, the oil replenishing one-way valve 341 cannot be opened, then the hydraulic oil pumped by the auxiliary pump 32 cannot flow to the second work port B through the oil replenishing one-way valve 341, but only flows to the first work port A through the oil way between the oil outlet of the auxiliary pump 32 and the first work port A, so as to replenish necessary oil for the first work port A.

As can be seen, based on the arrangement manner of the present embodiment, the auxiliary pump 32 is capable of replenishing oil not only for the pump motor 31 in the pump work condition, but also for the pump motor 31 in the motor work condition, thus auxiliary boosting of the pump motor 31 in both work conditions can be realized to prevent the pump motor 31 from generating cavitation erosion in both the pump work condition and the motor work condition, which improves the work performance of the pump motor 31 and prolongs the service life of the pump motor 31.

In addition, as illustrated by FIG. 1, in the present embodiment, the hydraulic energy conversion device 3 further includes a relief valve 342, whose oil inlet communicates with the second work port B, and the oil outlet communicates with the oil outlet of the auxiliary pump 32. As the relief valve 342 can be opened when the pressure at the second work port B is too high, enabling the oil of the second work port B to overflow to the first work port A through the relief valve 342 and the oil passage between the oil outlet of the auxiliary pump 32 and the first work port A (at this time, the pump motor 31 is in the pump work condition, forming an internal oil circulation), thereby a high pressure overflow function of the second work port B can be realized to protect the pump motor 31 working in the pump work condition.

Moreover, as shown in FIG. 1, in the present embodiment, the oil replenishing one-way valve 341 and the relief valve 342 are integrated as an oil replenishing relief valve 34, such that the oil outlet of the auxiliary pump 32 is connected with the second work port B through the oil replenishing relief valve 34, which makes the crane hydraulic control system of the present embodiment have a simpler and more compact structure and be more convenient to control.

The power transmission control device is for controlling whether the prime mover 1 is in power connection with the hydraulic energy conversion device 3 or not, so that the prime mover 1 and the hydraulic energy conversion device 3 can be switched between the power connection state and the power disconnection state. Based on the power transmission control device, the prime mover 1 and the hydraulic energy conversion device 3 may only be switched to the power connection state if needed, therefore, compared with the case that the prime mover 1 and the hydraulic energy conversion device 3 are always in the power connection state, the energy consumption can be reduced more effectively, and the cost is reduced.

Specifically, as illustrated by FIG. 1, the power transmission control device in the present embodiment includes a clutch 81 and a clutch control device 82, wherein the clutch 81 is connected between the prime mover 1 and the hydraulic energy conversion device 3, and the clutch control device 82 is used for controlling the clutch 81 to switch between a connection state and a disconnection state, so as to control the relationship of the hydraulic energy conversion device 3 and the prime mover 1 to switch between the power connection state and the power disconnection state. In the process of implementing the driving energy recovery function and in the process of implementing the operation energy recovery function, the clutch control device 82 controls the clutch 81 to be in the connection state, so as to control the hydraulic energy conversion device 3 and the prime mover 1 be in the power connection state, making the prime mover 1 be capable of transmitting power to the hydraulic energy conversion device 3, accordingly, the hydraulic energy conversion device 3 can cooperate with the operation energy recycling device and the running energy recycling device to implement the energy recovery function; and furthermore, when the actuator executes operations normally, the clutch control device 82 can also control the clutch 81 to be in the connection state, which enables the hydraulic energy conversion device 3 to conveniently supply oil for on the superstructure operating normally on one hand, and on the other hand, enables the recovered energy in the lowering operation process to be used again to help to improve the oil suction performance of the pump motor 31.

In a normal running process of the crane, if the prime mover 1 is capable of meeting the driving requirements by itself, the clutch control device 82 controls the clutch 81 to be in the disconnection state, so as to control the hydraulic energy conversion device 3 and the prime mover 1 to be in the power disconnection state, cutting off the power transmission from the prime mover 1 to the hydraulic energy conversion device 3, accordingly, the hydraulic energy conversion device 3 and the like do not affect the normal running process; while if the prime mover 1 is difficult to meet the driving requirements, such as when starting or climbing and the like, the clutch control device 82 controls the clutch 81 to be in the connection state, so that the energy recovered in a driving braking process can be used again and converted into the mechanical energy to assist the driving.

More specifically, it can be seen from FIG. 1 that, the clutch control device 82 in the present embodiment is implemented as a hydraulic component, which is specifically a two-position three-way solenoid valve with a control end Y10, such that the clutch 81 is controlled in a hydraulic mode. However, those skilled in the art should understand that, in other embodiments of the present disclosure, the clutch 81 may also be controlled in other manners such as electric mode or mechanical mode, etc.

The execution control mechanism is for controlling the actuator of the crane to execute the operation, for example, hoisting, derricking, telescoping and other operations. As shown in FIG. 1, in the present embodiment, the execution control mechanism includes a winch control mechanism and a derricking control mechanism, wherein: the winch control mechanism, for controlling the winch of the actuator to execute the winch lifting operation and the winch lowering operation, includes the winch motor 211 and the winch motor control device, the winch motor 211 is for driving the winch to rotate, and the winch motor control device controls one of the lifting port H and the lowering port D of the winch motor 211 to take oil and the other to discharge oil to control the steering of the winch motor 211, so as to control the winch to execute the winch lifting operation or the winch lowering operation; and the derricking control mechanism, for controlling the actuator to execute the derricking lifting operation and the derricking lowering operation, includes the derricking cylinder 221 and the derricking cylinder control device, the derricking cylinder 221 is for driving the jibs to derricking, and the derricking cylinder control device is for controlling the extension and retraction of the cylinder rod of the derricking cylinder 221 by controlling one of the rod cavity and the rodless cavity of the derricking cylinder 221 to take oil and the other to discharge oil, so as to control the implementation of the derricking lifting operation or the derricking lowering operation.

Specifically, as can be seen from FIG. 1, the winch motor control device in the present embodiment includes the winch up-down control valve 212 and a winch balance control mechanism 213; and the derricking control mechanism in the present embodiment includes the derricking up-down control valve 222 and a derricking balance control mechanism 223.

The winch up-down control valve 212 is used for controlling the direction of the hydraulic oil flowing through the winch motor 221, thereby controlling the winch to execute the winch lifting operation or the winch lowering operation by controlling the steering of the winch motor 221. As shown in FIG. 1, the winch up-down control valve 212 in the present embodiment includes a first valve port, a second valve port, a third valve port and a fourth valve port, wherein the first valve port is connected with a superstructure oil supply device of the crane, the second valve port communicates with the oil tank 7, the third valve port is connected with the lifting port H in an on-off mode, and the fourth valve port communicates with the lowering port D; and the winch up-down control valve 212 has a first working state (corresponding to an upper position in FIG. 1) and a second working state (corresponding to a lower position in FIG. 1), wherein: when the winch up-down control valve 212 is in the first working state, the first valve port communicates with the third valve port of the winch up-down control valve 212, and the second valve port communicates with the fourth valve port of the winch up-down control valve 212, so that the pressure oil supplied by the superstructure oil supply device can flow into the lifting port H via the winch up-down control valve 212 at this time and flow back into the oil tank 7 from the lowering port D via the winch up-down control valve 212, thereby driving the winch motor 211 to rotate toward a first direction (referred to as forward rotation) to realize the winch lifting operation; and when the winch up-down control valve 212 is in the second working state, the first valve port communicates with the fourth valve port of the winch up-down control valve 212, and the second valve port communicates with the third valve port of the winch up-down control valve 212, so that the pressure oil supplied by the superstructure oil supply device can enter the lowering port D via the winch up-down control valve 212 in the second working state at this time, and flow back into the oil tank 7 from the lifting port H via the winch up-down control valve 212 in the second working state, thereby driving the winch motor 211 to rotate toward a second direction opposite to the first direction (referred to as reverse rotation) to realize the winch lowering operation.

Moreover, as can be seen from FIG. 1, the winch up-down control valve 212 in the present embodiment also has a third working state (corresponding to a middle position as shown in FIG. 1), and when the winch up-down control valve 212 is in the third working state, the first valve port is disconnected from the third valve port of the winch up-down control valve 212, and the second valve port communicates with the fourth valve port of the winch up-down control valve 212, so that the pressure oil supplied by the superstructure oil supply device cannot form a loop via the winch up-down control valve 212 at this time, and the winch operation is stopped. It should be noted that the third working state of the winch up-down control valve 212 is not limited to the mode as shown in FIG. 1, such as, for stopping the winch operation, the winch up-down control valve 212 may be also configured in such a way that the first valve port, the second valve port, the third valve port and the fourth valve port are all cut off in the third working state.

The winch balance control mechanism 213 is disposed between the lifting port H and the third valve port of the winch up-down control valve 212, and is for improving the safety of the winch operation process by controlling the communication and disconnection between the third valve port of the winch up-down control valve 212 and the lifting port H.

As can be seen from FIG. 1, the winch balance control mechanism 213 in the present embodiment includes a winch balance valve 2131 which includes a first valve port and a second valve port, wherein the first valve port of the winch balance valve 2131 communicates with the third valve port of the winch up-down control valve 212, and the second valve port of the winch balance valve 2131 communicates with the lifting port H; and the winch balance valve 2131 has a first working state (corresponding to the left position in FIG. 1) and a second working state (corresponding to the right position in FIG. 1), wherein: when the winch balance valve 2131 is in the first working state, the first valve port of the winch balance valve 2131 unidirectionally communicates with the second valve port along a direction from the third valve port of the winch up-down control valve 212 to the lifting port H, so that the hydraulic oil can only flow from the third valve port of the winch up-down control valve 212 to the lifting port H when flowing through the winch balance valve 2131 in the first working state and cannot reversely flow, thus improving the safety of the winch operation; and when the winch balance valve 2131 is in the second working state, the first valve port of the winch balance valve 2131 communicates with the second valve port, so that the hydraulic oil can flow to the third valve port of the winch up-down control valve 212 from the lifting port H through the winch balance valve 2131 in the second working state, thus conveniently implementing the winch lowering operation.

More specifically, as shown in FIG. 1, when the winch balance valve 2131 is in the first working state, a one-way valve is disposed between the first valve port and the second valve port of the winch balance valve 2131 for implementing the unidirectional communication along the direction from the third valve port of the winch up-down control valve 212 to the lifting port H; and when the winch balance valve 2131 is in the second working state, the first valve port of the winch balance valve 2131 communicates with the second valve port via damping, in this way, in this way, the flow rate flowing through the winch balance valve 2131 can be adjusted by adjusting the damping, and then the winch lowering speed can be adjusted.

Therefore, by controlling the winch balance valve 2131 to switch between the first working state and the second working state, the communication and disconnection between the third valve port of the winch up-down control valve 212 and the lifting port H are controlled.

In order to conveniently control the winch balance valve 2131 to switch between the first working state and the second working state, as shown in FIG. 1, the winch balance control mechanism 213 in the present embodiment further includes a winch balance valve control valve 2132, the winch balance valve control valve 2132, connecting with the control end Y9 of the winch balance valve 2131, is for controlling whether the oil is supplied to the control end Y9 of the winch balance valve 2131 or not, so as to control the winch balance valve 2131 to switch between the first working state and the second working state.

The derricking up-down control valve 222 is used for controlling the flow direction of the hydraulic oil flowing through the derricking cylinder 221, so as to control the execution of the derricking lifting operation or the derricking lowering operation by controlling the extension and retraction of the derricking cylinder 221. As shown in FIG. 1, the derricking up-down control valve 222 in the present embodiment includes a first valve port, a second valve port, a third valve port and a fourth valve port, wherein the first valve port of the derricking up-down control valve 222 is connected with the superstructure oil supply device of the crane, the second valve port of the derricking up-down control valve 222 communicates with the oil tank 7, the third valve port of the derricking up-down control valve 222 is connected with the rodless cavity of the derricking cylinder 221 in an on-off mode, and the fourth valve port of the derricking up-down control valve 222 communicates with the rod cavity of the derricking cylinder 221; and the derricking up-down control valve 222 has a first working state (corresponding to the upper position in FIG. 1) and a second working state (corresponding to the lower position in FIG. 1), wherein: when the derricking up-down control valve 222 is in the first working state, the first valve port of the derricking up-down control valve 222 communicates with the third valve port, and the second valve port communicates with the fourth valve port, so that the pressure oil supplied by the superstructure oil supply device can enter the rod cavity of the derricking cylinder 221 via the derricking up-down control valve 222 at this time, and the hydraulic oil in the rod cavity of the derricking cylinder 221 can flow back into the oil tank 7 via the derricking up-down control valve 222 again to drive the cylinder rod of the derricking cylinder 221 to stretch out, implementing the derricking lifting operation; and when the derricking up-down control valve 222 is in the second working state, the first valve port of the derricking up-down control valve 222 communicates with the fourth valve port, and the second valve port communicates with the third valve port, so that the pressure oil supplied by the superstructure oil supply device can enter the rodless cavity of the derricking cylinder 221 via the derricking up-down control valve 222 at this time, and the hydraulic oil in the rodless cavity of the derricking cylinder 221 can flow back into the oil tank 7 via the derricking up-down control valve 222 again to drive the cylinder rod of the derricking cylinder 221 to retract back, implementing the derricking lowering operation.

Moreover, as can be seen from FIG. 1, the derricking up-down control valve 222 in the present embodiment also has a third working state (corresponding to the middle position in FIG. 1), and when the derricking up-down control valve 222 is in the third working state, the first valve port of the derricking up-down control valve 222 is disconnected from the third valve port, and the second valve port communicates with the fourth valve port, so that the pressure oil supplied by the superstructure oil supply device cannot form a loop via the derricking up-down control valve 222 at this time, and then the derricking operation stops. Of course, to stop the derricking operation, the derricking up-down control valve 222 may also be configured to in such a way that the first valve port, the second valve port, the third valve port and the fourth valve port are all cut off in the third working state. Based on the third working state of the derricking up-down control valve 222 as shown in FIG. 1, the derricking lowering operation energy recovery function can be implemented more conveniently, and in the process of implementing the derricking lowering operation energy recovery function, oil may be conveniently replenished for the rod cavity of the derricking cylinder 221 by injecting pressure oil into the second valve port of the derricking up-down control valve 222 in the third working state to prevent cavitation erosion.

The derricking balance control mechanism 223 is disposed between the rodless cavity of the derricking cylinder 221 and the third valve port of the derricking up-down control valve 222, and improves the safety of the derricking operation by controlling the communication and disconnection between the third valve port of the derricking up-down control valve 222 and the rodless cavity of the derricking cylinder 221.

As can be seen from FIG. 1, the derricking balance control mechanism in the present embodiment includes a derricking balance valve 2231, the derricking balance valve 2231 includes a first valve port and a second valve port, the first valve port of the derricking balance valve 2231 communicates with the third valve port of the derricking up-down control valve 222, and the second valve port of the derricking balance valve 2231 communicates with the rodless cavity of the derricking cylinder 221; and the derricking balance valve 2231 has a first working state (corresponding to the left position in FIG. 1) and a second working state (corresponding to the right position in FIG. 1), wherein: when the derricking balance valve 2231 is in the first working state, the first valve port of the derricking balance valve 2231 unidirectionally communicates with the second valve port along a direction from the third valve port of the derricking up-down control valve 222 to the rodless cavity of the derricking cylinder 221, so that the oil can only flow from the third valve port of the derricking up-down control valve 222 to the rodless cavity of the derricking cylinder 221 when flowing through the derricking balance valve 2231 in the first working state and cannot reversely flow, thus improving the safety of the derricking operation; and when the derricking balance valve 2231 is in the second working state, the first valve port of the derricking balance valve 2231 communicates with the second valve port, so that the hydraulic oil can flow through the derricking balance valve 2231 in the second working state from the rodless cavity of the derricking cylinder 221 to the third valve port of the derricking up-down control valve 222, and thus the derricking lowering operation may be conveniently implemented.

More specifically, as shown in FIG. 1, when the derricking balance valve 2231 is in the first working state, a one-way valve is arranged between the first valve port and the second valve port of the derricking balance valve 2231 for implementing the unidirectional communication along the direction from the third valve port of the derricking up-down control valve 222 to the rodless cavity of the derricking cylinder 221; and when the derricking balance valve 2231 is in the second working state, the first valve port of the derricking balance valve 2231 communicates with the second valve port via damping, in this way, the flow rate flowing through the derricking balance valve 2231 can be adjusted by adjusting the damping, and then the derricking lowering speed can be adjusted.

Therefore, by controlling the derricking balance valve 2231 to switch between the first working state and the second working state, the communication and disconnection between the third valve port of the derricking up-down control valve 222 and the rodless cavity of the derricking cylinder 221 can be controlled.

In order to conveniently control the derricking balance valve 2231 to switch between the first working state and the second working state, as shown in FIG. 1, the derricking balance control mechanism 223 in the present embodiment further includes a derricking balance valve control valve 2232 connected to the control end Y8 of the derricking balance valve 2231, the derricking balance valve control valve 2232 is for controlling whether supply oil to the control end Y8 of the derricking balance valve 2231 or not, so as to control the derricking balance valve 2231 to switch between the first working state and the second working state.

As described above, in the present embodiment, when the winch up-down control valve 212 and the derricking up-down control valve 222 are in the third working state, the respective second valve ports communicate with the respective fourth valve ports, which brings the advantages that when the lowering operation is implemented, the pressure oil is conveniently injected into the respective second valve ports to implement a lowering oil replenishing function, thereby preventing the air suction phenomenon of the lowering port D of the winch motor 211 and the rod cavity 221 of the derricking cylinder 221 in the lowering process, and then further reducing the risk of lowering stall.

In addition, it should be noted that, in order to realize a simpler structure and more convenient control, in FIG. 1, the winch up-down control valve 212 is implemented as a four-position three-way valve with control ends Y61 and Y62, and the derricking up-down control valve 222 is implemented as a four-position three-way valve with control ends Y71 and Y72, however, those skilled in the art should understand that the winch up-down control valve 212 and the derricking up-down control valve 222 are not limited thereto, for example, hydraulic control valves may also be adopted, or corresponding functions may also be achieved by the combination of several valves.

The aforementioned superstructure oil supply device is for supplying oil for the execution control mechanism in the superstructure operation process. In order to reduce the problems of system inactivity, impact, slow response, or jitter in a multi-action composite work condition, in the present embodiment, the superstructure oil supply device connected with the first valve port of the winch up-down control valve 212 and the first valve port of the derricking up-down control valve 222 is implemented as a multi-pump system, which not only includes the hydraulic energy conversion device 3 in the present embodiment, but also includes the main superstructure oil supply device (which may include one or more pumps), that is, in the present embodiment, the hydraulic energy conversion device 3 and the main superstructure oil supply device are both used as the oil sources of superstructure to supply oil for the superstructure, and furthermore, since the hydraulic energy conversion device 3 and the main superstructure oil supply device are independently arranged, the oil source of the execution control mechanism is independent, which is conducive to improving the composite work condition performance. Moreover, compared with the case that only one of the hydraulic energy conversion device 3 and the main superstructure oil supply device supplies oil for the superstructure, this setting way of the present embodiment can also reduce the requirements for the hydraulic energy conversion device 3 and the main superstructure oil supply device, so that the hydraulic energy conversion device 3 and/or the main superstructure oil supply device with relatively small installation power can be conveniently used, which is conducive to further reducing the emission of harmful gases and is conducive to further prolonging the service life of the prime mover 1 and the like.

The connection implementation manner of the first valve port of the winch up-down control valve 212 and the first valve port of the derricking up-down control valve 222 with the hydraulic control device 3 will be described in more detail later when the operation energy recycling device is described. Herein, only the connection implementation manner of the first valve port of the winch up-down control valve 212 and the first valve port of the derricking up-down control valve 222 with the main superstructure oil supply device is illustrated at first.

In the present embodiment, the first valve port of the winch up-down control valve 212 and the first valve port of the derricking up-down control valve 222 are connected with the main superstructure oil supply device through a one-way valve. Specifically, as shown in FIG. 1, the main superstructure oil supply device of the present embodiment is connected with the first valve port of the winch up-down control valve 212 and the first valve port of the derricking up-down control valve 222 through a first one-way valve 23, wherein the oil inlet of the first one-way valve 23 communicates with the main superstructure oil supply device, the oil outlet of the first one-way valve 23 is connected with both of the first valve port of the winch up-down control valve 212 and the first valve port of the derricking up-down control valve 222, such that the main superstructure oil supply device is not only unidirectionally communicated with the first valve port of the winch up-down control valve 212 along a direction from the main superstructure oil supply device to the first valve port of the winch up-down control valve 212, but also unidirectionally communicated with the first valve port of the derricking up-down control valve 222 along a direction from the main superstructure oil supply device to the first valve port of the derricking up-down control valve 222. The advantages of this arrangement are that the mutual independence between the hydraulic energy conversion device 3 as the superstructure oil source and the main superstructure oil supply device is further ensured, unnecessary reverse flow of the hydraulic oil is prevented, and the work stability and reliability of the crane hydraulic control system of the present embodiment are improved.

As can be seen, in the present embodiment, the first valve port of the winch up-down control valve 212 and the first valve port of the derricking up-down control valve 222 are connected with the main superstructure oil supply device, so that the main superstructure oil supply device is capable of supplying oil for the superstructure.

In addition, as can be seen from FIG. 1, in the present embodiment, the second valve port of the winch up-down control valve 212 and the second valve port of the derricking up-down control valve 222 are also connected with the oil tank 7 through a one-way valve (a second one-way valve 24 as shown in FIG. 1). In this way, the second valve port of the winch up-down control valve 212 unidirectionally communicates with the oil tank 7 along a direction from the second valve port of the winch up-down control valve 212 to the oil tank 7, and the second valve port of the derricking up-down control valve 222 unidirectionally communicates with the oil tank 7 along a direction from the second valve port of the derricking up-down control valve 222 to the oil tank 7. Since unexpected reverse oil flow between the oil tank 7 and the winch up-down control valve 212 and between the oil tank 7 and the derricking up-down control valve 222 can be prevented, the work stability and reliability of the crane hydraulic control system of the present embodiment can be improved. Moreover, as shown in FIG. 1, in the present embodiment, a return oil filter 25 is provided on the oil way between the second one-way valve 24 and the oil tank 7, and the oil return filter 25 is used for filtering the oil flowing back into the oil tank 7, thereby being conducive to improving the purity of the oil in the oil tank 7, and thus the work reliability of the crane hydraulic control system of the present embodiment can be further improved.

The operation energy recycling device is for cooperating with the hydraulic energy conversion device 3 to implement the operation energy recovery function. In the present embodiment, the operation energy recycling device is configured to recover the gravitational potential energy in the winch lowering operation process as well as in the derricking lowering operation process, so that the operation energy recovery function implemented by the crane hydraulic control system of the present embodiment not only includes the winch lowering operation energy recovery function, but also includes the derricking lowering operation energy recovery function.

As shown in FIG. 1, the operation energy recycling device in the present embodiment includes a first energy accumulator 51, a first energy storage control valve 53 and an energy recovery switching valve 54, wherein: the first energy accumulator 51 is for storing the energy recovered in the lowering operation process, and is connected with the first work port A in an on-off mode through the first energy storage control valve 53; the first energy storage control valve 53, serving as the third on-off control device, is connected between the first energy accumulator 51 and the first work port A for controlling the communication and disconnection between the first energy accumulator 51 and the first work port A; the energy recovery switching valve 54 which is used as the energy recovery switching device is connected between the second valve port of the upper and lower vehicle switching valve 4 and the execution control mechanism, and the energy recovery switching valve 54 is not only for controlling the second valve port of the upper and lower vehicle switching valve 4 to switchably communicate with one of the lifting port H and the rodless cavity of the derricking cylinder 221, so as to switchably implement the winch lowering operation energy recovery function and the derricking lowering operation energy recovery function, but also for controlling the communication and disconnection between the second valve port of the upper and lower vehicle switching valve 4 and the winch motor control device and between the second valve port of the upper and lower vehicle switching valve 4 and the derricking cylinder control device, so that the second valve port of the upper and lower vehicle switching valve 4 is connected with the winch motor 211 through the winch motor control device and is connected with the derricking cylinder 221 through the derricking cylinder control device, which facilitates the hydraulic energy conversion device 3 to supply oil for at least one of the winch motor 211 and the derricking cylinder 221 in the normal superstructure operation process.

Specifically, as shown in FIG. 1, the first energy storage control valve 53 in the present embodiment includes a first valve port and a second valve port, the first valve port of the first energy storage control valve 53 communicates with the first work port A, and the second valve port of the first energy storage control valve 53 communicates with the first energy accumulator 51; and the first energy storage control valve 53 has a first working state (corresponding to the left position in FIG. 1) and a second working state (corresponding to the right position in FIG. 1), wherein: when the first energy storage control valve 53 is in the first working state, the first valve port of the first energy storage control valve 53 unidirectionally communicates with the second valve port along a direction from the first work port A to the first energy accumulator 51; and when the first energy storage control valve 53 is in the second working state, the first valve port communicates with the second port of the first energy storage control valve 53.

By providing the first energy storage control valve 53, the communication and disconnection between the first energy accumulator 51 and the first work port A can be controlled, furthermore, when the energy in the lowering operation process needs to be recovered, the first energy storage control valve 53 can be controlled to be in the first working state, so that the pump motor 31 working in the motor work condition conveniently conveys the superstructure return oil into the first energy accumulator 51 for recovery and storage, and since the first valve port unidirectionally communicates with the second valve port of the first energy storage control valve 53 along the direction from the first work port A to the first energy accumulator 51, the hydraulic oil stored in the first energy accumulator 51 won't reversely flow out after the recovery is completed, thus realizing reliable storage of hydraulic energy; and when the stored hydraulic energy needs to be reused, the first energy storage control valve 53 is switched to the second working state, so that the hydraulic oil stored in the first energy accumulator 51 is released to help to improve the oil suction function of the pump motor 31.

In FIG. 1, the unidirectional communication between the first valve port and the second valve port of the first energy storage control valve 53 in the first working state is achieved by a one-way valve connected therebetween, but it should be noted that, in other embodiments of the present disclosure, the first valve port and the second valve port of the first energy storage control valve 53 may also be disconnected in the first working state, for example, the first valve port and the second valve port of the first energy storage control valve 53 may both be cut off in the first working state, or the first valve port and the second valve port of the first energy storage control valve 53 may be connected by two reversely arranged one-way valves in the first working state, in this case, the stable and reliable operation energy recovery function can also be implemented by controlling the first energy storage control valve 53 to be in the second working state when operation energy recovery needs to be performed and when the recovered energy needs to be reused, and to be in the first working state at other situation. In addition, the first energy storage control valve 53 as shown in FIG. 1 is a two-position two-way solenoid valve having a control end Y3, so that the first energy storage control valve 53 can be conveniently controlled to switch between the first working state and the second working state by controlling whether the control end Y3 is energized or not, however, those skilled in the art will appreciate that the first energy storage control valve 53 is not limited to the particular structural form.

As shown in FIG. 1, the energy recovery switching valve 54 in the present embodiment is a three-position four-way valve having control ends Y51 and Y52, which includes a first valve port, a second valve port, a third valve port and a fourth valve port, wherein: the first valve port of the energy recovery switching valve 54 communicates with the second valve port of the upper and lower vehicle switching valve 4, the second valve port of the energy recovery switching valve 54 communicates with the lifting port H, the third valve port of the energy recovery switching valve 54 unidirectionally communicates with the rodless cavity of the derricking cylinder 221 along a direction from the second valve port to the rodless cavity of the derricking cylinder 221, and the fourth valve port of the energy recovery switching valve 54 is connected with the winch motor control device and the derricking cylinder control device. Moreover, the energy recovery switching valve 54 has a first valve position (a right position in FIG. 1), a second valve position (a left position in FIG. 1) and a third valve position (a middle position in FIG. 1), wherein: when the energy recovery switching valve 54 is at the first valve position, the energy recovery switching valve 54 works in the first working state, in which the first valve port thereof communicates with the second valve port, and both of the third valve port and the fourth valve are cut off; when the energy recovery switching valve 54 is at the second valve position, the energy recovery switching valve 54 works in the second working state, in which the first valve port thereof communicates with the third valve port, and both of the second valve port and the fourth valve port are cut off; and when the energy recovery switching valve 54 is at the third valve position, the energy recovery switching valve 54 works in the third working state, in which the first valve port thereof communicates with the fourth valve port, and both of the second valve port and the third valve port are cut off.

Based on the above energy recovery switching valve 54, when the gravitational potential energy in the winch lowering operation process needs to be recovered, the energy recovery switching valve 54 can be switched to the first valve position, so that the hydraulic oil flowing out from the lifting port H in the winch lowering operation process can conveniently flow to the upper and lower vehicle switching valve 4 in the second working state through the energy recovery switching valve 54, and finally flows into the first energy accumulator 51 under the driving action of the pump motor 31 that works in the motor work condition to implement the winch lowering operation energy recovery function; when the gravitational potential energy in the derricking lowering operation process needs to be recovered, the energy recovery switching valve 54 can be controlled to switch to the second valve position, so that the hydraulic oil flowing out from the rodless cavity of the derricking cylinder 221 can conveniently flow to the upper and lower vehicle switching valve 4 in the second working state through the energy recovery switching valve 54, and finally flows into the first energy accumulator 51 under the driving action of the pump motor 31 that works in the motor work condition to implement the derricking lowering operation energy recovery function; and furthermore, and when the superstructure energy does not need to be recovered in the normal superstructure operation process, the energy recovery switching valve 54 can be controlled to be at the third valve position, so that the pump motor 31 that works in the pump work condition can conveniently drive the hydraulic oil to flow to the winch motor control device and the derricking cylinder control device through the upper and lower vehicle switching valve 4 in the second working state and the energy recovery switching valve 54, and then a normal superstructure operation oil supply function is implemented.

In the present embodiment, as shown in FIG. 1, the unidirectional communication between the third valve port of the energy recovery switching valve 54 and the rod cavity of the derricking cylinder 221 is implemented by the derricking balance valve 2231. Specifically, the third valve port of the energy recovery switching valve 54 communicates with the first valve port of the derricking balance valve 2231, so that when in the first working state, the derricking balance valve 2231 enables the third valve port of the energy recovery switching valve 54 to be unidirectionally communicated with the rodless cavity of the derricking cylinder 221 along a direction from the second valve port to the rodless cavity of the derricking cylinder 221. This arrangement has the advantages that the work safety is higher, and the load lowering speed may be adjusted by the derricking balance valve 2231 in an initial phase of a derricking lowering energy recovery process.

In addition, as shown in FIG. 1, the aforementioned connection between the fourth valve port of the energy recovery switching valve 54 and the winch motor control device is specified in the present embodiment as the connection between the fourth valve port of the energy recovery switching valve 54 and the first valve port of the winch up-down control valve 212, and aforementioned connection between the fourth valve port of the energy recovery switching valve 54 and the derricking cylinder control device is specified in the present embodiment as the connection between the fourth valve port of the energy recovery switching valve 54 and the first valve port of the derricking up-down control valve 222. Based on this, in the superstructure normal operation process, the hydraulic energy conversion device 3 can cooperate with the main superstructure oil supply device to supply oil for the winch motor 211 together through the winch up-down control valve 212 and/or for the derricking cylinder 221 through the derricking up-down control valve 222. Moreover, as can be seen from FIG. 1, in the present embodiment, a third one-way valve 56 is further provided on the oil way between the fourth valve port of the energy recovery switching valve 54 and the first valve port of the winch up-down control valve 212 as well as the first valve port of the derricking up-down control valve 222. Similar to the first one-way valve 23, based on the third one-way valve 56, the mutual independence between the main superstructure oil supply device and the hydraulic energy conversion device 3 serving as the superstructure oil source. Further, by setting the first one-way valve 23 and the third one-way valve 56 at the same time, the hydraulic oil supplied from one of the main superstructure oil supply device and the hydraulic energy conversion device 3 is prevented from flowing to the other, thereby ensuring that the hydraulic oil supplied by the both flows as desired, and then making the crane hydraulic control system can work more reliably and reliably.

As can be seen, by controlling the energy recovery switching valve 54, which communicates the second valve port of the upper and lower vehicle switching valve 54 with the execution control mechanism, to switch among the three valve positions, it's not only convenient for the switchably implementation of the winch lowering operation energy recovery function and the derricking lowering energy recovery function, but also convenient for the hydraulic energy conversion device 3 to implement the normal superstructure oil supply function.

In order to conveniently control the energy recovery switching valve 54 to switch among the three valve positions, as shown in FIG. 1, the energy recovery switching valve 54 in the present embodiment has two control ends Y51 and Y52, and at least one of the two control ends Y51 and Y52 is electrically connected with the controller 9, and the energy recovery switching valve 54 is controlled by the controller 9 to switch among the three valve positions.

In addition, as shown in FIG. 1, in the present embodiment, the operation energy recycling device further includes a superstructure pressure detection device 55 and a first energy storage pressure detection device 52.

The superstructure pressure detection device 55 is for detecting the pressure of the execution control mechanism. Specifically, as can be seen from FIG. 1, the superstructure pressure detection device 55 in the present embodiment is disposed on the oil way between the second valve port of the upper and lower vehicle switching valve 4 and the first valve port of the energy recovery switching valve 54, so that it's convenient for the superstructure pressure detection device 55 to detect the pressure of the execution control mechanism in the superstructure lowering operation process, accordingly, whether the operation energy recovery function needs to be performed may be judged according to the pressure of the execution control mechanism, which is accurate and convenient; and furthermore, in the present embodiment, the superstructure pressure detection device 55 is electrically connected with the controller 9, so that the superstructure pressure detection device 55 is capable of feeding back the detected pressure of the execution control mechanism to the controller 9 in time, and then it's convenient for the controller 9 to control the various hydraulic valves of the crane hydraulic control system and the pump motor 31 and the like to be in the required working states when the operation energy recovery is needed.

The first energy storage pressure detection device 52 is for detecting the pressure of the first energy accumulator 51. Specifically, as can be seen from FIG. 1, the first energy storage pressure detection device 52 in the present embodiment is arranged on the oil way between the first energy accumulator 51 and the first energy storage control valve 53, in this way, the first energy storage pressure detection device 52 is capable of conveniently detecting the pressure of the first energy accumulator 51 in the operation energy recovery process, so that the oil way between the first work port A and the first energy accumulator 51 is cut off after the pressure in the first energy accumulator 51 reaches a set value, thereby improving the safety of the operation energy recovery process; and moreover, the first energy storage pressure detection device 52 in the present embodiment is also electrically connected with the controller 9, so that the controller 9 is capable of conveniently and accurately controlling the various hydraulic valves, the pump motor 31 and the like to be in the required working states according to the pressure of the first energy accumulator 51.

The running energy recycling device is used to cooperate with the hydraulic energy conversion device 3 to implement the driving energy recovery function. As shown in FIG. 1, in the present embodiment, the running energy recycling device includes a second energy accumulator 61, a second energy storage control valve 63 and a second energy storage pressure detection device 62, wherein: the second energy accumulator 61, which is for storing the energy recovered in the driving braking process, is connected with the second work port B in an on-off mode through the second energy storage control valve 63; the second energy storage control valve 63, serving as the fourth on-off control device, is connected between the second energy accumulator 61 and the second work port B for controlling the communication and disconnection between the second energy accumulator 61 and the second work port B; and the second energy storage pressure detection device 62 is for detecting the pressure of the second energy accumulator 61.

Specifically, as shown in FIG. 1, the second energy storage control valve 63 in the present embodiment includes a first valve port and a second valve port, the first valve port of the second energy storage control valve 63 communicates with the second work port B, and the second valve port of the second energy storage control valve 63 communicates with the second energy accumulator 61; and the second energy storage control valve 63 has a first working state (corresponding to the left position in FIG. 1) and a second working state (corresponding to the right position in FIG. 1), wherein: when the second energy storage control valve 63 is in the first working state, the first valve port of the second energy storage control valve 63 is disconnected from the second valve port; and when the second energy storage control valve 63 is in the second working state, the first valve port of the second energy storage control valve 63 communicates with the second valve port.

Based on the above second energy storage control valve 63, the communication and disconnection between the second energy accumulator 61 and the second work port B can be controlled, moreover, when the energy in the driving braking process needs to be recovered, the second energy storage control valve 63 can be switched to the second working state, so that the pump motor 31 that works in the pump work condition is capable of convening the hydraulic oil to the second energy accumulator 61 for recovery and storage under the driving of the prime mover 1, after the recovery is completed, the second energy storage control valve 63 can be switched to the first working state to prevent the hydraulic oil from flowing into the second energy accumulator 61 again and also preventing the hydraulic oil stored in the second energy accumulator 61 from flowing out, and when the stored hydraulic energy needs to be reused, the second energy storage control valve 63 can be switched to the second working state again, so that the hydraulic oil stored in the second energy accumulator 61 can flow via the second energy storage control valve 63 to the pump motor 31 in the pump work condition, thereby outputting mechanical energy to assist the crane to start or climb, etc.

More specifically, as can be seen from FIG. 1, in the present embodiment, the first valve port and the second valve port of the second energy storage control valve 63 in the first working state are disconnected by two reversely arranged one-way valves. However, it should be understood by those skilled in the art that, in fact, the disconnection state of the first valve port and the second valve port of the second energy storage control valve 63 in the first working state may be also implemented by configuring the first valve port and the second valve port of the second energy storage control valve 63 to be directly cut off in the first working state; and furthermore, the control end Y4 of the second energy storage control valve 63 in the present embodiment is electrically connected with the controller 9, so that the controller 9 is capable of conveniently controlling the second energy storage control valve 63 to switch between the first working state and the second working state.

The second energy storage pressure detection device 62 is used for detecting the pressure of the second energy accumulator 61. Specifically, as can be seen from FIG. 1, the second energy storage pressure detection device 62 of the present embodiment is arranged on the oil way between the second energy accumulator 61 and the second energy storage control valve 63, so that the second energy storage pressure detection device 62 is capable of conveniently detecting the pressure of the second energy accumulator 61 in the driving energy recovery process, and after the pressure in the second energy accumulator 61 reaches the set value, the second work port B can be conveniently controlled to disconnect from the second energy accumulator 61, thereby improving the safety of the driving energy recovery process; and moreover, the second energy storage pressure detection device 62 of the present embodiment is also electrically connected with the controller 9, so that the controller 9 is capable of conveniently and accurately controlling the various hydraulic valves, the pump motor 31 and the like to be in the required working states according to the pressure of the second energy accumulator 61.

Based on the hydraulic circuit as shown in FIG. 1, the working principle of the crane hydraulic control system in the present embodiment is as follows:

(1) when the lower vehicle drives normally, the clutch control device 82 controls the clutch 81 to be in the disconnection state, at this time, the hydraulic energy conversion device 3 and the prime mover 1 are in the power disconnection state, in which the hydraulic energy conversion device 3 does not work, and the prime mover 1 drives the crane to travel normally. In this process, a position of the pedal of the crane, the gear position of the gearbox, the pressure of the second energy accumulator 61 detected by the second energy storage pressure detection device 62 and other parameters can be based on to judge whether the driving braking kinetic energy can be recovered, and if so, the driving energy recovery function is started.

(2) When the driving energy recovery function needs to be implemented, the control end Y10 of the clutch control device 82 is energized to switch the clutch 81 to the connection state, so that the hydraulic energy conversion device 3 and the prime mover 1 are switched to the power connection state, accordingly, the driving inertia energy (mechanical energy) generated by the prime mover 1 and a transmission and the like can be transmitted to the pump motor 31, at this time, the variable displacement mechanism 311 controls the pump motor 31 to be in the pump work condition and energizes the control end Y4 of the second energy storage control valve 63 to control the second energy storage control valve 63 to switch to the second working state, then the pump motor 31 can pump the oiling from the oil tank 7 and output the pressurized oil into the second energy accumulator 61 through the second work port B and the second energy storage control valve 63, and accordingly, the mechanical energy in the driving braking process is converted into the hydraulic energy stored in the second energy accumulator 61, thus the driving energy recovery function being realized. In this process, the auxiliary pump 32 is also driven to work to replenish oil to the first work port A, and the pressure oil pumped out by the auxiliary pump 32 from the oil tank 7 flows to the first work port A through the oil way between the oil outlet of the auxiliary pump 32 and the first work port A to be conveyed into the second energy accumulator 61 together with the oil pumped by the pump motor 31 from the oil tank 7 after being pressurized by the pump motor 31.

In the above-mentioned driving energy recovery process, the pressure in the second energy accumulator 61 can be detected in real time by the second energy storage pressure detection device 62, and it is detected that the pressure in the second energy accumulator 61 reaches a certain threshold, the second energy storage control valve 63 is controlled to switch to the first working state, such that the pressure oil no longer flows into the second energy accumulator 61, thereby improving the safety of the driving energy recovery process.

The above-mentioned recovered driving braking energy may be utilized again when needed (for example, when the crane is started next time): the pump motor 31 is controlled to switch to the motor work condition, the control end Y4 of the second energy storage control valve 63 and the control end Y1 of the control valve 331 of one-way valve are energized to control the second energy storage control valve 63 to switch to the second working state, and to control the hydraulically controlled check valve 33 to open bidirectionally, and the clutch 81 is started, then the hydraulic oil stored in the second energy accumulator 61 can flow back to the oil tank 7 through the second energy storage control valve 63, the pump motor 31 and the hydraulically controlled check valve 33, so that the hydraulic energy stored in the second energy accumulator 61 can be released and drive a transmission shaft to rotate, and the output mechanical energy can assist the crane to start or climb. In this process, the auxiliary pump 32 is also driven to work, the hydraulic oil pumped out by the auxiliary pump 32 from the oil tank 7 flows through the oil outlet thereof and the oil replenishing one-way valve 341 to the second work port B to replenish oil to the second work port B, so that the energy discharge process is smoother and more efficient, and the service life of the pump motor 31 can be further prolonged, because the reason of which lies that, when the energy discharge is completed, the pressure oil in the first energy accumulator 61 stops flowing out, even if the clutch 81 is cut off at this time, the pump motor 31 however still continues to rotate under the action of the motion inertia, so that the oil in the oil way between the second work port B and the second accumulator pressure control valve 63 will quickly flow back to the oil tank 7 through the pump motor 31, and if no oil is replenished to the second work port B at this time, the pump motor 31 will generate cavitation erosion, which affects the service life of the pump motor 31 as well as the smoothness of the energy discharge process.

(3) When the superstructure operates normally, the main superstructure oil supply device and the hydraulic energy conversion device 3 are both used as the superstructure oil sources for supplying oil to the execution control mechanism. The oil supplied by the main superstructure oil supply device is output to the execution control mechanism through the first one-way valve 23. In order to realize the normal superstructure operation oil supply function of the hydraulic energy conversion device 3, in the normal superstructure operation process, the clutch 81 is controlled to be in the connection state, the pump motor 31 is adjusted to be in the pump work condition, and the control end Y2 of the upper and lower vehicle switching valve 4 is energized to switch the upper and lower vehicle switching valve 4 to the second valve position, and meanwhile the control end Y1 of the one-way valve control valve 33 land the control ends Y51 and Y52 of the energy recovery switching valve 54 are all not energized, controlling the hydraulically controlled check valve 33 to be only unidirectionally opened and the energy recovery switching valve 54 to be at the third valve position (the middle position), so that under the driving action of the prime mover 1, the hydraulic energy conversion device 3 is capable of pressurizing the oil and drive the pressured oil flowing out from the second work port B to flow into the execution control mechanism through the upper and lower vehicle switching valve 4 and the energy recovery switching valve 54, thereby realizing oil supply for the superstructure. In this process, both of the pump motor 31 and the auxiliary pump 32 pump oil from the oil tank 7, and the pressure oil pumped by the auxiliary pump 32 flows to the first work port A through the oil way between the oil outlet of the auxiliary pump 32 and the first work port A, and flows to the execution control mechanism together with the oil pumped out by the pump motor 31 from the oil tank 7 after the pressurization of the pump motor 31.

Taking the winch lifting operation as an example, the control end Y62 of the winch up-down control valve 212 is energized and the control end Y9 of the winch balance valve 2131 is out of hydraulic oil at this time, so that the winch up-down control valve 212 is in the first working state (the upper position) and the winch balance valve 2131 is in the first working state (the left position), therefore, the pressure oil supplied by the main superstructure oil supply device and the pressure oil supplied by the hydraulic energy conversion device 3 can flow into the lifting port H of the winch motor 211 through the winch up-down control valve 212 and the winch balance valve 2131, and flow back to the oil tank 7 from the lowering port D through the winch up-down control valve 212 and the winch balance valve 2131, so that the winch motor 211 can drive the winch to rotate positively to drive the weight to lift, implementing the winch lifting operation.

Similarly, in the winch lowering operation process, the control end Y61 of the winch up-down control valve 212 is energized and the control end Y9 of the winch balance valve 2131 is supplied with oil, so that the winch up-down control valve 212 is in the second working state (the lower position) and the winch balance valve 2131 is in the second working state (the right position), therefore, the pressure oil supplied by the main superstructure oil supply device and the pressure oil supplied by the hydraulic energy conversion device 3 can flow into the lowering port D of the winch motor 211 through the winch up-down control valve 212, and flow back to the oil tank 7 from the lifting port H through the winch balance valve 2131, the winch up-down control valve 212 and the second one-way valve 24, so that the winch motor 211 can drive the winch to rotate negatively to drive the weight to drop, implementing the winch lowering operation.

Similarly, in the derricking lifting operation process, the pressure oil supplied by the main superstructure oil supply device and the hydraulic energy conversion device 3 can flow into the rodless cavity of the derricking cylinder 221 through the upper position of the derricking up-down control valve 222 and the left position of the derricking balance valve 2231, and the oil in the rod cavity of the derricking cylinder 221 can flow back into the oil tank 7 through the derricking up-down control valve 222 and the second one-way valve 24, so that the cylinder rod of the derricking cylinder 221 extends out to drive the weight to lift, and then the derricking lifting operation is realized; and in the derricking lowering operation process, the pressure oil supplied by the main superstructure oil supply device and the hydraulic energy conversion device 3 can flow into the rod cavity of the derricking cylinder 221 through the lower position of the derricking up-down control valve 222, and the oil in the rodless cavity of the derricking cylinder 221 can flow back into the oil tank through the right position of the derricking balance valve 2231, the derricking up-down control valve 222 and the second one-way valve 24, so that the cylinder rod of the derricking cylinder 221 retracts back to drive the weight to drop, and then the derricking lowering operation is realized.

In the process of executing the superstructure lowering operation (the winch lowering operation and the derricking lowering operation), the pressure of the execution control mechanism may be detected by the superstructure pressure detection device 55, and whether the gravitational potential energy in the lowering operation process needs to be recovered is judged according to the detected pressure value, and if so, the operation energy recovery function is started.

(4) The operation energy recovery process is divided into two cases:

(41) The winch lowering operation energy recovery process: in the winch lowering operation process, if the superstructure pressure detection device 55 detects that the energy in the winch lowering operation process needs to be recovered, the control end Y51 of the energy recovery switching valve 54 is energized to control the energy recovery switching valve 54 to switch to the first valve position (the right position), at this time, the upper and lower vehicle switching valve 4 is in the second working state (the right position), the winch balance valve 2131 is in the first working state (the left position), the first energy storage control valve 53 is in the first working state (the left position), the hydraulic control end of the hydraulically controlled check valve 33 is out of oil (that is, the oil way from the first work port A to the oil tank 7 is cut off), and the clutch 81 is in the connection state, therefore, when the pump motor 31 is switched to the motor work condition, under the driving of the pump motor 31, the hydraulic oil flowing out from the lifting port H in the load lowering process can flow into the first energy accumulator 51 through the energy recovery switching valve 54, the upper and lower vehicle switching valve 4, the second work port B, the first work port A and the first energy storage control valve 53, so that the gravitational potential energy lost in the winch lowering operation process is converted into the hydraulic energy stored in the first energy accumulator 51, and then the winch lowering operation energy recovery function is implemented.

In the above-mentioned winch lowering operation energy recovery process, the dropping speed of the weight may be controlled by adjusting the displacement of the pump motor 31, in this case, the winch balance valve 2131 needn't be used to adjust the dropping speed of the weight, therefore, it's conducive to reducing the heat generation of the system and improving the performance of the system; moreover, the mechanical energy outputted by the pump motor 31 in the motor work condition may be further utilized to assist the prime mover 1 to drive the main superstructure oil supply device to work, the winch up-down control valve 212 may be controlled to be in the second working state (the lower position) and the winch balance valve 2131 may be controlled to be in the first working state, in this case, the main superstructure oil supply device is capable of replenishing oil for the lowering port D through the first one-way valve 23 and the winch up-down control valve 212, thereby reducing the risk of cavitation erosion at the lowering port D, prolonging the service life of the winch motor 211, and improving the smoothness of the energy recovery process.

In addition, in order to prevent the sudden drop of the weight caused by the sudden switch of the pump motor 31 from the pump work condition to the motor work condition, and to further improve the load lowering safety in the winch lowering operation energy recovery process, the pump motor 31 may be controlled to work in the pump work condition before the pump motor 31 is switched to the motor work condition, so that the pump motor 31 is capable of injecting the pressure oil into the oil way between the second work port B and the listing port H to establish a pressure to support the load, and then the pump motor 31 is adjusted to gradually switch to the motor work condition, in this way, at the moment that a winch brake is started, an instantaneous high-speed rotation of the winch motor 211, which is caused for the reason that the oil way between the second work port B and the listing port H is not filled with the oil to establish the pressure in advance, and which results in a load lowering jitter and affects the dropping stability, may be avoided.

(42) The derricking lowering operation energy recovery process: when the gravitational potential energy in the derricking lowering operation process needs to be recovered, the energy recovery switching valve 54 is controlled to switch to the second valve position (the left position), and the derricking up-down control valve 222 is controlled to be in the third working state (the middle position), at this time, and similarly to the above-described winch lowering operation energy recovery process, the upper and lower vehicle switching valve 4 is also in the second working state (the right position), the first energy storage control valve 53 is also in the first working state (the left position), the hydraulic control end of the hydraulically controlled check valve 33 is out of oil (that is, the oil way from the first work port A to the oil tank 7 is cut off), and the clutch 81 is also in the connection state, therefore, the derricking balance valve 2231 is controlled to be in the second working state (the right position), and the pump motor 31 is controlled to switch to the motor work condition, then the hydraulic oil flowing out from the rodless cavity of the derricking cylinder 221 in the load lowering process can flow into the first energy accumulator 51 under the driving of the pump motor 31 through the derricking balance valve 2231, the energy recovery switching valve 54, the upper and lower vehicle switching valve 4, the second work port B, the first work port A and the first energy storage control valve 53, in this way, the gravitational potential energy lost in the derricking lowering operation process is converted into the hydraulic energy stored in the first energy accumulator 51, and then the derricking lowering operation energy recovery function is implemented. In this process, since the derricking up-down control valve 222 is in the third working state, and the second valve port thereof communicates with the fourth valve port, another oil source may be injected to the second valve port to replenish oil to the rod cavity of the derricking cylinder 221 to prevent the air suction phenomenon.

In order to control the load lowering speed in the derricking lowering operation energy recovery process more stably and more effectively, in the initial phase of the derricking lowering operation energy recovery process (the valve port at the right position of the derricking balance valve 2231 is not fully opened), the opening size of the valve port at the right position of the derricking balance valve 2231 may be controlled to adjust the load lowering speed, so as to achieve a micro-motion lowering process, at this time, the pump motor 31 may be controlled to work in a small displacement motor work condition; and then, after the valve port at the right position of the derricking balance valve 2231 is fully opened, the load lowering speed may be controlled by adjusting the displacement of the pump motor 31.

Moreover, similarly to the winch lowering operation energy recovery process, in order to further improve the load lowering safety in the derricking lowering operation energy recovery process, the pump motor 31 may also be controlled to work in the pump work condition at first to establish the pressure, and then be gradually controlled to switch to the motor work condition.

It should be noted that, in the above-mentioned winch lowering operation energy recovery process and the derricking lowering operation energy recovery process, the pressure oil output by the auxiliary pump 32 firstly flows into the first energy accumulator 51 together with the hydraulic oil output by the pump motor 31 through the first energy storage control valve 53 for storage; further, first energy storage pressure detection device 52 detects the pressure of the first energy accumulator 51, and when the first energy storage pressure detection device 52 detects that the pressure of the first energy accumulator 51 reaches a certain threshold, the control end Y1 of the one-way valve control valve 331 may be energized, so that the hydraulically controlled check valve 33 is opened bidirectionally due to the oil passing through the hydraulic control end, accordingly, the hydraulic oil output by the winch motor 31 and the auxiliary pump 32 can return to the oil tank 7 through the hydraulically controlled check valve 33 for unloading.

In addition, it should be noted that, no matter the energy recovered in the above winch lowering operation energy recovery process or the energy recovered in the derricking lowering operation energy recovery process can be used again during the next superstructure operation, as long as the winch motor 31 is controlled to work in the pump work condition and the first energy storage control valve 53 is controlled to switch to the second working state (the right position), then under the driving of the pump motor 31, the pressure oil stored in the first energy accumulator 51 can be released and output to the first work port A to assist to improve the oil absorption performance of the pump motor 31, thereby preventing the pump motor 31 from generating air suction, so that the hydraulic energy conversion device 3 is capable of better supplying oil for the normal superstructure operation.

As can be seen, based on the crane hydraulic control system as shown in FIG. 1, the present embodiment can conveniently implement the driving energy recovery function, the winch lowering operation energy recovery function and the derricking lowering operation energy recovery function. Since the kinetic energy in the driving braking process and the gravitational potential energy in the lowering operation process can be used again, the energy loss caused by the direct conversion of these energy into heat energy can be effectively reduced, and the purpose of energy saving and emission reduction may be achieved. Moreover, the crane hydraulic control system of the present embodiment has a relatively simple structure and a lower cost. When any one of the above three energy recovery functions is separately implemented, only the clutch control device 82, the pump motor 31 and the energy recovery switching valve 54 (two proportional signals and two switching signals) are controlled, so that the control process is simpler and the control precision is higher.

In the above embodiment, the first energy storage pressure detection device 51, the second energy storage pressure detection device 52 and the superstructure pressure detection device 55 may adopt pressure sensors and other structural forms. In addition, those skilled in the art should understand that, in the above embodiments, the hydraulic valves steering in the electric control mode may also steer in hydraulic control or mechanical control manner actually, similar, the hydraulic valves steering in the hydraulic control mode may also steer in the electric control or mechanical control manner; and furthermore, although the hydraulic valves shown in the above embodiments all adopt single-valve structures, and the respective working states of the hydraulic valves are in one-to-one correspondence with the respective valve positions, it should be noted that the hydraulic valves actually may also implementing the corresponding functions by adopting the combined structures of a plurality of valves in which the respective working states of the hydraulic valves are no longer limited to correspond to a certain valve position of a certain valve, but these variations are also intended to be within the protection scope of the present disclosure.

The above descriptions are only exemplary embodiments of the present disclosure, and are not intended to limit the present disclosure. Any modifications, equivalents, improvements and the like, made within the spirit and principle of the present disclosure, should be included in the protection scope of the present disclosure.

The invention claimed is:

1. A crane hydraulic control system, comprising:

a prime mover, for driving a crane to run;

an execution control mechanism, for controlling an actuator of the crane to execute an operation;

a hydraulic energy conversion device, having a state of power connection with the prime mover, and comprising a pump motor switchable between a pump work condition and a motor work condition, the pump motor is provided with a first work port connected with an oil tank in an on-off mode and a second work port connected with the execution control mechanism in an on-off mode;

an operation energy recycling device, comprising a first energy accumulator connected with the first work port in an on-off mode, and a running energy recycling device, comprising a second energy accumulator connected with the second work port in an on-off mode;

wherein:

the operation energy recycling device cooperates with the hydraulic energy conversion device to convert gravitational potential energy in a load lowering operation process executed by the actuator into hydraulic energy and store the hydraulic energy in the first energy accumulator, so as to achieve an operation energy recovery function, during which the pump motor is in the motor work condition, the first work port is communicated with the first energy accumulator, an oil passage from the first work port to the oil tank is disconnected, and the second work port is communicated with the execution control mechanism and is disconnected from the second energy accumulator; and the running energy recycling device cooperates with the hydraulic energy conversion device to convert mechanical energy in the braking process of the crane into hydraulic energy and store the hydraulic energy in the second energy accumulator, so as to achieve a driving energy recovery function, during which the pump motor is in the pump work condition, the first work port is communicated with the oil tank, and the second work port is communicated with the second energy accumulator and is disconnected from the execution control mechanism.

2. The crane hydraulic control system according to claim 1, wherein the hydraulic energy conversion device is configured to supply oil to the execution control mechanism when the actuator executes the operation, during which the pump motor is in the pump work condition, the first work port is communicated with the oil tank, and the second work port is communicated with the execution control mechanism and is disconnected from the second energy accumulator.

3. The crane hydraulic control system according to claim 1, further comprising a first on-off control device for controlling the communication and disconnection between the first work port and the oil tank, and a second on-off control device for controlling the communication and disconnection between the second work port and the execution control mechanism, the operation energy recycling device further comprises a third on-off control device for controlling the communication and disconnection between the first energy accumulator and the first work port, and the running energy recycling device further comprises a fourth on-off control device for controlling the communication and disconnection between the second energy accumulator and the second work port, wherein:

when the operation energy recovery function is implemented, the first on-off control device controls the oil way from the first work port to the oil tank to be disconnected, the second on-off control device controls the second work port to communicate with the execution control mechanism, the third on-off control device controls the first work port to communicate with the first energy accumulator, and the fourth on-off control device controls the second work port to be disconnected from the second energy accumulator; and when the driving energy recovery function is implemented, the first on-off control device controls the first work port to communicate with the oil tank, the second on-off control device controls the second work port to be disconnected from the execution control mechanism, and the fourth on-off control device controls the second work port to communicate with the second energy accumulator.

4. The crane hydraulic control system according to claim 3, wherein at least one of:

the first on-off control device comprises a hydraulically controlled check valve, and an oil inlet of the hydraulically controlled check valve communicates with the oil tank, and an oil outlet of the hydraulically controlled check valve communicates with the first work port;

the second on-off control device comprises a upper and lower vehicle switching valve, wherein the upper and lower vehicle switching valve comprises a first valve port and a second valve port, the first valve port of the upper and lower vehicle switching valve communicates with the second work port, the second valve port of the upper and lower vehicle switching valve communicates with the execution control mechanism, the upper and lower vehicle switching valve has a first working state and a second working state, when the upper and lower vehicle switching valve is in the first working state, the first valve port of the upper and lower vehicle switching valve is disconnected from the second valve port of the upper and lower vehicle switching valve, and when the upper and lower vehicle switching valve is in the second working state, the first valve port of the upper and lower vehicle switching valve communicates with the second valve port of the upper and lower vehicle switching valve;

the third on-off control device comprises a first energy storage control valve, and the first energy storage control valve comprises a first valve port and a second valve port, wherein the first valve port of the first energy storage control valve communicates with the first work port, the second valve port of the first energy storage control valve communicates with the first energy accumulator, and the first energy storage control valve has a first working state and a second working state, when the first energy storage control valve is in the first working state, the first valve port of the first energy storage control valve is disconnected from the second valve port, or the first valve port of the first energy storage control valve unidirectionally communicates with the second valve port of the first energy storage control valve along a direction from the first work port to the first energy accumulator, and when the first energy storage control valve is in the second working state, the first valve port of the first energy storage control valve communicates with the second valve port of the first energy storage control valve; and the fourth on-off control device comprises a second energy storage control valve, and the second energy storage control valve comprises a first valve port and a second valve port, the first valve port of the second energy storage control valve communicates with the second work port, the second valve port of the second energy storage control valve communicates with the second energy accumulator, and the second energy storage control valve has a first working state and a second working state, when the second energy storage control valve is in the first working state, the first valve port of the second energy storage control valve is disconnected from the second valve port of the second energy storage control valve, and when the second energy storage control valve is in the second working state, the first valve port of the second energy storage control valve communicates with the second valve port of the second energy storage control valve.

5. The crane hydraulic control system according to claim 4, wherein at least one of:

the execution control mechanism comprises a winch control mechanism for controlling a winch of the actuator to execute winch lifting or winch lowering operations, and the winch control mechanism comprises a winch motor having a lifting port and a lowering port, the second valve port of the upper and lower vehicle switching valve is connected with the lifting port, and when the execution control mechanism controls the winch to execute the winch lowering operation, the second valve port of the upper and lower vehicle switching valve is communicated with the lifting port, so as to implement a winch lowering operation energy recovery function; and the execution control mechanism comprises a derricking control mechanism for controlling the actuator to execute derricking lifting or derricking lowering operations, the derricking control mechanism comprises a derricking cylinder, the second valve port of the upper and lower vehicle switching valve is connected with a rodless cavity of the derricking cylinder, and when the derricking control mechanism controls the actuator to execute a derricking lowering operation, the second valve port of the upper and lower vehicle switching valve is communicated with the rodless cavity of the derricking cylinder, so as to implement a derricking lowering operation energy recovery function.

6. The crane hydraulic control system according to claim 5, wherein the execution control mechanism comprises the winch control mechanism and the derricking control mechanism, and the operation energy recycling device further comprises an energy recovery switching device disposed between the second valve port of the upper and lower vehicle switching valve and the execution control mechanism, the energy recovery switching device for controlling the second valve port of the upper and lower vehicle switching valve to switchably communicate with one of the lifting port and the rodless cavity of the derricking cylinder, so as to switchably implement one of the winch lowering operation energy recovery function and the derricking lowering operation energy recovery function.

7. The crane hydraulic control system according to claim 6, wherein the energy recovery switching device comprises an energy recovery switching valve, the energy recovery switching valve comprises a first valve port, a second valve port and a third valve port, the first valve port of the energy recovery switching valve communicates with the second valve port of the upper and lower vehicle switching valve, the second valve port of the energy recovery switching valve communicates with the lifting port, the third valve port of the energy recovery switching valve communicates with the rodless cavity of the derricking cylinder, and the energy recovery switching valve has a first working state and a second working state, when the energy recovery switching valve is in the first working state, the first valve port and the second valve port of the energy recovery switching valve are communicated with each other and the third valve port thereof is cut off, and when the energy recovery switching valve is in the second working state, the first valve port and the third valve port of the energy recovery switching valve are communicated with each other and the second valve port thereof is cut off.

8. The crane hydraulic control system according to claim 7, wherein the energy recovery switching valve further comprises a fourth valve port communicated with the execution control mechanism, when the energy recovery switching valve is in the first working state and when the energy recovery switching valve is in the second working state, the fourth valve port of the energy recovery switching valve is cut off, and the energy recovery switching valve further has a third working state, in which the fourth valve port and the first valve port of the energy recovery switching valve are communicated with each other, and the second valve port and the third valve port of the energy recovery switching valve are both cut off, so that the hydraulic energy conversion device is configured to supply oil to the execution control mechanism when the actuator executes the operation normally.

9. The crane hydraulic control system according to claim 8, wherein at least one of:

the winch control mechanism further comprises a winch motor control device for controlling one of the lifting port and the lowering port to take oil and the other to discharge oil, and the fourth valve port of the energy recovery switching valve is connected with the winch motor through the winch motor control device; and the derricking control mechanism further comprises a derricking cylinder control device for controlling one of a rod cavity and the rodless cavity of the derricking cylinder to take oil and the other to discharge oil, and the fourth valve port of the energy recovery switching valve is connected with the derricking cylinder through the derricking cylinder control device.

10. The crane hydraulic control system according to claim 9, wherein at least one of:

the winch motor control device comprises a winch up-down control valve, the winch up-down control valve comprises a first valve port, a second valve port, a third valve port and a fourth valve port, the first valve port of the winch up-down control valve communicates with the fourth valve port of the energy recovery switching valve, the second valve port of the winch up-down control valve communicates with the oil tank, the third valve port of the winch up-down control valve is connected with the lifting port in an on-off mode, the fourth valve port of the winch up-down control valve communicates with the lowering port, and the winch up-down control valve has a first working state and a second working state, when the winch up-down control valve is in the first working state, the first valve port communicates with the third valve port of the winch up-down control valve, and the second valve port communicates with the fourth valve port of the winch up-down control valve; and when the winch up-down control valve is in the second working state, the first valve port communicates with the fourth valve port of the winch up-down control valve, and the second valve port communicates with the third valve port of the winch up-down control valve; and the derricking cylinder control device comprises a derricking up-down control valve, the derricking up-down control valve comprises a first valve port, a second valve port, a third valve port and a fourth valve port, the first valve port of the derricking up-down control valve communicates with the fourth valve port of the energy recovery switching valve, the second valve port of the derricking up-down control valve communicates with the oil tank, the third valve port of the derricking up-down control valve is connected with the rodless cavity of the derricking cylinder in an on-off mode, the fourth valve port of the derricking up-down control valve communicates with the rod cavity of the derricking cylinder, and the derricking up-down control valve has a first working state and a second working state, when the derricking up-down control valve is in the first working state, the first valve port communicates with the third valve port of the derricking up-down control valve, and the second valve port communicates with the fourth valve port of the derricking up-down control valve; and when the derricking up-down control valve is in the second working state, the first valve port communicates with the fourth valve port of the derricking up-down control valve, and the second valve port communicates with the third valve port of the derricking up-down control valve.

11. The crane hydraulic control system according to claim 10, wherein:

the derricking cylinder control device further comprises a derricking balance valve, the derricking balance valve comprises a first valve port and a second valve port, the first valve port of the derricking balance valve communicates with the third valve port of the derricking up-down control valve, the second valve port of the derricking balance valve communicates with the rodless cavity of the derricking cylinder, and the derricking balance valve has a first working state and a second working state, when the derricking balance valve is in the first working state, the first valve port of the derricking balance valve unidirectionally communicates with the second valve port along a direction from the third valve port of the derricking up-down control valve to the rodless cavity of the derricking cylinder, and when the derricking balance valve is in the second working state, the first valve port of the derricking balance valve communicates with the second valve port; and the third valve port of the energy recovery switching valve communicates with the first valve port of the derricking balance valve.

12. The crane hydraulic control system according to claim 10, wherein the first valve port of the winch up-down control valve is also connected with a main superstructure oil supply device of the crane, so that the main superstructure oil supply device is also configured to supply oil to the winch control mechanism; and/or the first valve port of the derricking up-down control valve is also connected with the main superstructure oil supply device, so that the main superstructure oil supply device is also configured to supply oil to the derricking control mechanism.

13. The crane hydraulic control system according to claim 12, wherein the first valve port of the winch up-down control valve unidirectionally communicates with the fourth valve port of the energy recovery switching valve along a direction from the fourth valve port of the energy recovery switching valve to the first valve port of the winch up-down control valve, and the first valve port of the winch up-down control valve unidirectionally communicates with the main superstructure oil supply device along a direction from the main superstructure oil supply device to the first valve port of the winch up-down control valve; and/or the first valve port of the derricking up-down control valve unidirectionally communicates with the fourth valve port of the energy recovery switching valve along a direction from the fourth valve port of the energy recovery switching valve to the first valve port of the derricking up-down control valve, and the first valve port of the derricking up-down control valve unidirectionally communicates with the main superstructure oil supply device along a direction from the main superstructure oil supply device to the first valve port of the derricking up-down control valve.

14. The crane hydraulic control system according to claim 1, further comprising a power transmission control device for controlling the prime mover and the hydraulic energy conversion device to switch between a power connection state and a power disconnection state, wherein in the process of implementing the driving energy recovery function and the operation energy recovery function, the power transmission control device controls the hydraulic energy conversion device and the prime mover to be in the power connection state.

15. The crane hydraulic control system according to claim 14, wherein in the process of the actuator executes the operation, the power transmission control device is for controlling the hydraulic energy conversion device and the prime mover to be in the power connection state.

16. The crane hydraulic control system according to claim 1, wherein the hydraulic energy conversion device further comprises an auxiliary pump, the oil inlet of the auxiliary pump communicates with the oil tank, and the oil outlet of the auxiliary pump communicates with the first work port.

17. The crane hydraulic control system according to claim 16, wherein the oil outlet of the auxiliary pump is further connected with the second work port, and when the pump motor is in the motor work condition, the oil outlet of the auxiliary pump is unidirectionally communicated with the second work port along a direction from the oil outlet of the auxiliary pump to the second work port, so that the auxiliary pump is configured to replenish oil for the pump motor when the pump motor is in the motor work condition.

18. The crane hydraulic control system according to claim 16, wherein the hydraulic energy conversion device further comprises an relief valve connecting the oil outlet of the auxiliary pump and the second work port, the oil inlet of the relief valve communicates with the second work port, and the oil outlet of the relief valve communicates with the oil outlet of the auxiliary pump.

19. The crane hydraulic control system according to claim 1, wherein the operation energy recycling device further comprises a first energy storage pressure detection device for detecting the pressure of the first energy accumulator; and/or the running energy recycling device further comprises a second energy storage pressure detection device for detecting the pressure of the second energy accumulator; and/or the operation energy recycling device further comprises a superstructure pressure detection device for detecting the pressure of the execution control mechanism.

20. A crane, comprising an actuator and the crane hydraulic control system according to claim 1.

* * * * *